US009739028B2

(12) United States Patent
Riccobene et al.

(10) Patent No.: US 9,739,028 B2
(45) Date of Patent: Aug. 22, 2017

(54) IRREGULAR TRAPEZOIDAL BUILDING UNIT AND WALL STRUCTURE INCLUDING SAME

(71) Applicant: Keystone Retaining Wall Systems LLC, Minneapolis, MN (US)

(72) Inventors: Thomas S. Riccobene, Albuquerque, NM (US); Robert A. MacDonald, Plymouth, MN (US)

(73) Assignee: KEYSTONE RETAINING WALL SYSTEMS LLC, Minneapolis, MN (US)

( * ) Notice: Subject to any disclaimer, the term of this patent is extended or adjusted under 35 U.S.C. 154(b) by 236 days.

(21) Appl. No.: 14/204,589

(22) Filed: Mar. 11, 2014

(65) Prior Publication Data

US 2014/0270988 A1 Sep. 18, 2014

Related U.S. Application Data

(60) Provisional application No. 61/788,855, filed on Mar. 15, 2013.

(51) Int. Cl.
*E02D 29/02* (2006.01)

(52) U.S. Cl.
CPC ..... *E02D 29/025* (2013.01)

(58) Field of Classification Search
CPC ..... E04C 1/00
USPC ..... 405/284, 286; 52/604, 605, 608
See application file for complete search history.

(56) References Cited

U.S. PATENT DOCUMENTS

| | | | |
|---|---|---|---|
| 3,394,521 | A | 7/1968 | Coleman |
| 4,217,740 | A | 8/1980 | Assanti |
| 4,354,773 | A | 10/1982 | Noack |
| 4,761,095 | A | 8/1988 | Bartechner |

(Continued)

FOREIGN PATENT DOCUMENTS

| | | |
|---|---|---|
| EP | 0171417 | 2/1986 |
| JP | 2004124634 | 4/2004 |
| WO | 2004085755 | 10/2004 |

OTHER PUBLICATIONS

Branko Grunbaum and G. C. Shepard, "Tilings and Patterns", W.H. Freeman and Company, New York, 1986, pp. 288-290 and 510.

(Continued)

*Primary Examiner* — Sean Andrish
(74) *Attorney, Agent, or Firm* — Greer, Burns & Crains, Ltd.

(57) ABSTRACT

An irregular trapezoidal structural unit configured to be arranged with other like units in courses to form a structure comprises opposing upper and lower surfaces, opposing irregular front and rear faces, and irregular opposed side faces. The side faces each include a general S-shape mating section that are translated images of each other such that each side of the unit will mate with either side face of another like unit. The front and rear faces optionally include S-shaped mating sections that are translated images of each other. Structures are formed in courses by arranging units side to side along a line to form at least a first course, wherein adjacent side faces mate and interlock. Optionally, a second course is disposed laterally adjacent the first course wherein adjacent front and rear faces mate and interlock. Additional courses can be added on top of the other courses forming wall structures.

18 Claims, 20 Drawing Sheets

(56) References Cited

U.S. PATENT DOCUMENTS

| | | | | |
|---|---|---|---|---|
| 4,773,790 | A | 9/1988 | Hagenah | |
| D343,238 | S | 1/1994 | Hair | |
| 5,348,417 | A | 9/1994 | Scheiwiller | |
| D397,802 | S | 9/1998 | Terry | |
| 6,447,213 | B1 | 9/2002 | MacDonald | |
| 6,615,561 | B2 | 9/2003 | MacDonald et al. | |
| 6,854,231 | B2 | 2/2005 | MacDonald et al. | |
| 6,907,705 | B2 | 6/2005 | Dean et al. | |
| D536,058 | S | 1/2007 | Riccobene | |
| 7,159,367 | B1 * | 1/2007 | King | A01G 1/08 47/33 |
| 7,168,892 | B1 | 1/2007 | MacDonald et al. | |
| 7,393,155 | B2 | 7/2008 | Riccobene | |
| 7,637,688 | B2 | 12/2009 | Riccobene | |
| D624,202 | S | 9/2010 | Thomassen et al. | |
| 7,849,656 | B2 | 12/2010 | Mugge et al. | |
| 8,101,113 | B2 | 1/2012 | Castonguay et al. | |
| 8,101,274 | B2 | 1/2012 | Spedden | |
| 8,336,274 | B2 | 12/2012 | Riccobene | |
| D674,510 | S | 1/2013 | Riccobene et al. | |
| 8,562,260 | B2 * | 10/2013 | Matys | E04C 1/395 405/286 |
| D695,922 | S * | 12/2013 | Dignard | D25/113 |
| 2003/0009970 | A1 * | 1/2003 | MacDonald | E02D 29/0283 52/562 |
| 2003/0070384 | A1 | 4/2003 | Drost | |
| 2004/0191461 | A1 | 9/2004 | Riccobene | |
| 2004/0250495 | A1 | 12/2004 | Manthei | |
| 2005/0166517 | A1 | 8/2005 | Manthei | |
| 2007/0077387 | A1 | 4/2007 | Riccobene | |
| 2008/0120931 | A1 * | 5/2008 | Joslyn | E04B 2/16 52/293.3 |
| 2008/0209828 | A1 | 9/2008 | Riccobene | |
| 2010/0307092 | A1 * | 12/2010 | Bouchard | B44C 1/28 52/311.1 |
| 2012/0189386 | A1 | 7/2012 | Castonguay et al. | |

OTHER PUBLICATIONS

Canyon Stone, CobbleTop and Sereno Stone Brochures, Riccobene Hardscape Innovations, 2010, pp. 1-11.

Country Stone 8-in L Tan Black Everest Edging Stone Brochure, retrieved from www.Lowes.com, Aug. 2, 2012, pp. 1-2.

Allen + Roth Bertram 12-in L × 4 Retaining Wall Block, retrieved from www.Lowes.com on Apr. 10, 2014, p. 1.

* cited by examiner

IRREGULAR TRAPEZOIDAL BUILDING UNIT AND WALL STRUCTURE INCLUDING SAME

PRIORITY CLAIM

This application claims the benefit of U.S. Provisional Patent Application No. 61/788,855, filed Mar. 15, 2013, under 35 U.S.C. §119.

FIELD OF THE INVENTION

The subject disclosure relates to repeating building units forming a structure, and more specifically relates to stones, bricks, and blocks for forming walls, edgers or other structures.

BACKGROUND

It is well known to construct walls and other structures with stone and bricks. Natural stone structures are constructed by cutting and fitting irregularly sized and shaped stones. The work requires a skilled stonemason to select, cut, and fit the stone. It is labor intensive, and accordingly expensive. Custom built natural stone structures, however, are very attractive and desirable.

It is also well known to construct walls and other structures with manufactured building units such as bricks and concrete blocks (CMU). Such units can be made from concrete, brick, or various other materials. Units are conventionally provided in geometric shapes, and are typically are laid in repeating patterns. It is desirable to construct walls, such as retaining walls, and other structures that have a unique appearance and are aesthetically pleasing. It is also desirable to construct such structures easily and economically from manufactured units.

SUMMARY

Building units and wall structures, e.g., partial or full wall systems constructed with building units, are provided. As used herein, the terms "building unit," "structural unit" or "unit" refers to concrete masonry units (CMU), bricks, blocks, stones, or other three dimensional units or objects that can be used in the construction of retaining walls, columns, or other wall structures, including interior and exterior structures, and including load bearing and non-load bearing structures.

An embodiment of the invention provides an irregular trapezoidal structural unit configured to be arranged with other like units in courses to form a wall or edger structure. The unit comprises an upper surface and a lower surface, in which the lower surface is opposed to the upper surface. A front face and an opposed rear face are disposed between the upper surface and the lower surface. The front face is longer than the rear face, and the front and rear faces have an irregular configuration. By "irregular," it is meant that the faces appear jagged or rough hewn and/or include complex curves, and is not merely a straight line or simple curve, e.g., a circular arc (though the surface contour can include one or more portions in a straight line or simple curve).

A first side face and an opposed second side face are disposed between the upper surface and the lower surface. Both the first side face and the second side face generally extend from the front face to the rear face. The first side face and the second side face each include a general S-shape mating section. The S-shape section of the first side face and the S-shape section of the second side face each are center rotational images about a midpoint or centerline. The S-shape section of the first side face is a translated image of the S-shape section of the second side face such that the first side of the unit will mate with either a first or second side face of another like unit and the second side face of the unit will mate with either a first or second side face of another like unit.

In preferred embodiments of the structural wall units, the front face and the rear face also each include a general S-shape section. The S-shape section of the front face and the S-shape section of the rear face each are center rotational images about a second centerline. In a preferred embodiment, the S-shape of the front face is a translated image of the S-shape of the rear face. In other embodiments, the configuration of the front and back S-shape sections can be different. In yet other embodiments, the front and rear faces do not include a general S-shape portion.

By the term "S-shape section" it is meant that the section has a generally convex portion and a complementary generally concave portion. The convex portion has substantially the same shape or configuration as the concave portion rotated 180 degrees about a midpoint of the S-shape section. S-shape can be and preferably is subtle, i.e., it not obvious or pronounced so that the side surface appears natural. Preferably, the S-shaped curves are substantially continuous, though this is not required. In other embodiments flat portions, sub-segments, or other features could be included as part of an S-curve. The mating of two complementary S-sections of adjacent units provide a lateral interlock between the units.

In an example embodiment, the unit surface can include corner portions, which refers to the portions of the outer surface between sides that are not configured to mate with adjacent building units. It should be appreciated that "corner portions" as the term is used herein have a length, i.e., they are not merely an angular point of converging lines. Corner portions can be substantially planar, generally rounded or irregularly shaped.

The terms "along," "translated," "center," "rotational," "perpendicular," and "parallel" should be understood not to necessarily refer to perfect alignment, direction, or orientation. Instead, such alignment, direction, or orientation can vary given manufacturing tolerances or designed variance, for instance, to provide a more natural effect. "Opposed" faces or surfaces need not be perfectly opposed for particular units, but can be generally on opposite sides of the unit. Similarly, "disposed between" need not require that every point of a particular face be completely located between particular faces or surfaces. "Essentially" (e.g., "essentially smooth," "essentially rough," or "essentially rounded") refers to an overall state. The term "between" can be considered inclusive or exclusive. "Downwardly" refers to a direction from the top surface towards the bottom surface. "First side" and "second side" are used for clarity of description, and are not intended to require a particular order. For instance, "first side" can refer to a left side and "second side" to a right side, or vice versa. Additionally, "front" and "rear" are used for clarity of description, and are not intended to require a particular unit orientation, including forwards or backwards, outwardly, inwardly, etc. For example, a "front" surface of a particular unit can be part of either a front or a rear of a course, partial structure, or structure. Similarly, a "rear" surface of a particular unit can be part of either a front or a rear of a course, partial structure, or structure.

Courses and partial structural systems (e.g., wall systems) including units according to inventive embodiments are also provided. A partial structure system can include a plurality of courses. An example course includes a plurality of units arranged side to side in a line to form a landscape edging structure, which edge may be straight, curvilinear, serpentine, or combinations thereof. It will be appreciated that courses and partial structural systems can stand alone or be a part of a larger structure.

In some example embodiments, the units are arranged to further provide at least a second course on top of the first course to construct a wall or partial wall. In other example embodiments, the units are arranged to further provide a second course that is parallel to the first course to provide a double course. Units in the second course can be, but need not be, staggered from left to right with respect to the units in the first course. Examples of staggered arrangement include, but are not limited to, running bond, half bond, quarter bond, three-quarter bond, etc. Other, non-staggered arrangements are possible, including stack bond arrangements. For retaining wall structures, higher courses can be arranged in a vertical or near-vertical arrangement with respect to lower courses, or can be arranged in a setback orientation, as will be appreciated by those of ordinary skill in the art.

In certain example embodiments, the configuration and/or orientation of particular units or courses can vary, and in other example embodiments, the configuration and/or orientation can be the same. In several example embodiments, the front/back orientation of units, courses, or even partial structures or total structures, can vary.

Other embodiments are discussed below in reference to the drawings. Still other embodiments will be apparent to those skilled in the art.

DETAILED DESCRIPTION

Various embodiments of the invention are described below by way of example only, with reference to the accompanying drawings. The drawings include schematic figures that may not be to scale, which will be fully understood by skilled artisans with reference to the accompanying description. Features may be exaggerated for purposes of illustration. From the preferred embodiments, artisans will recognize additional features and broader aspects of the invention.

Figure 1:
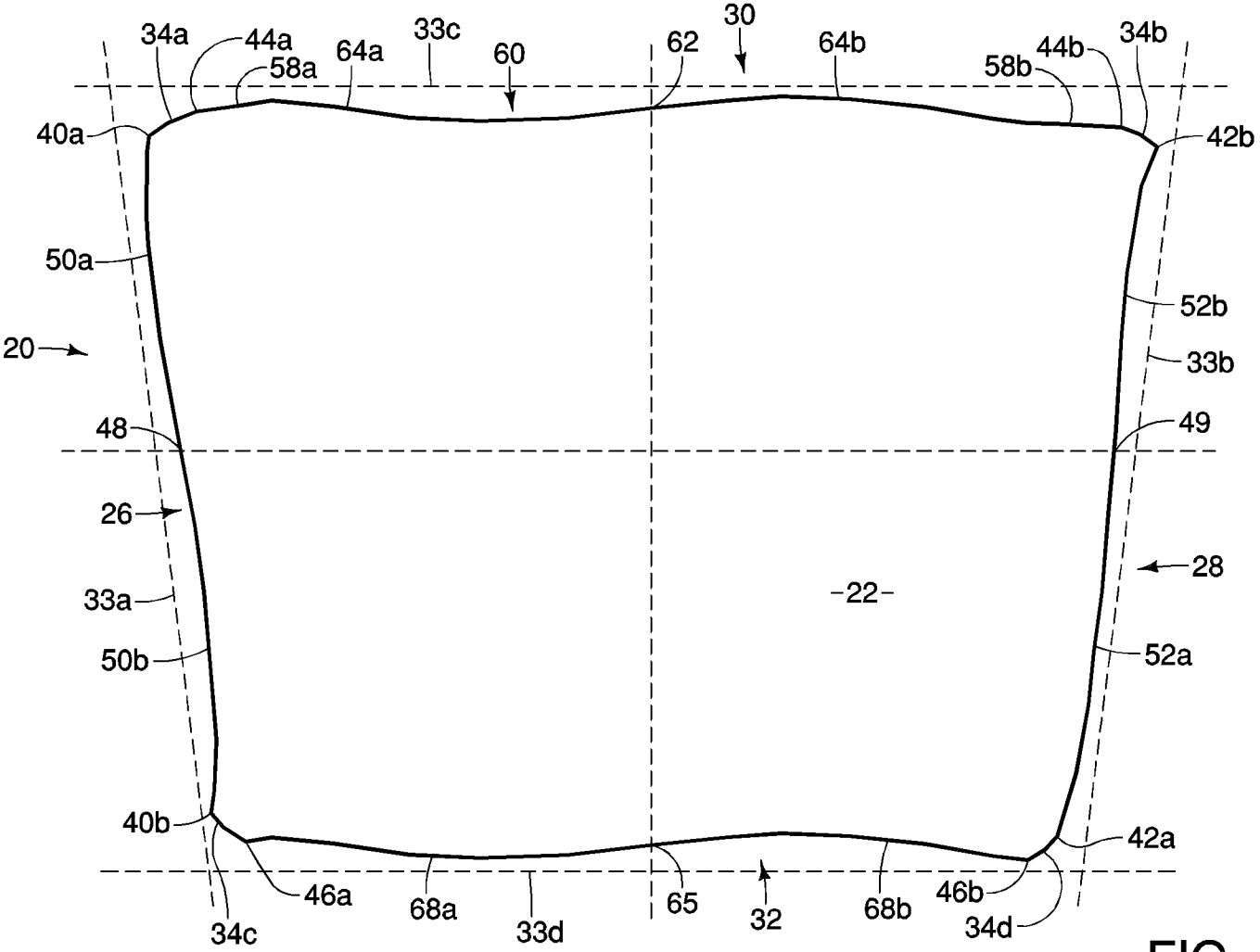
FIG. 1 is a top plan view of a structural wall unit according to a first embodiment of the invention.
Figure 2:
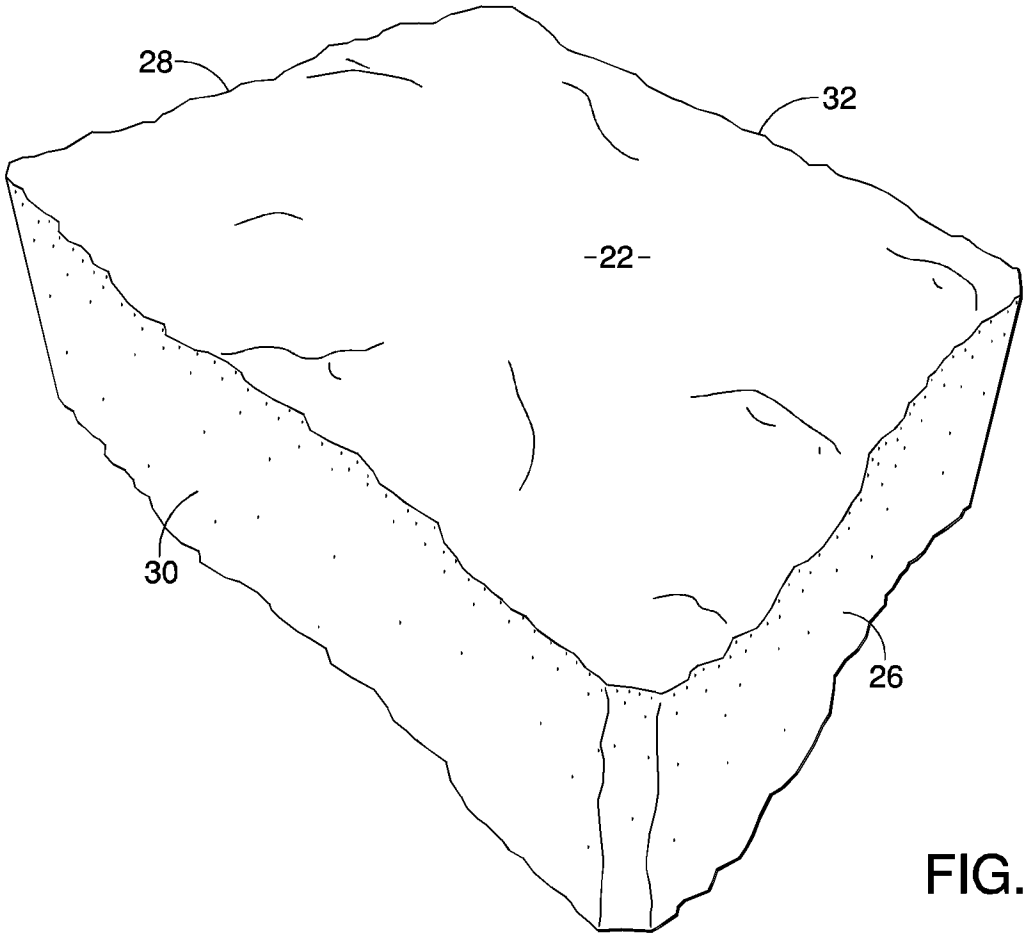
FIG. 2 is a perspective view of the first embodiment structural wall unit.
Figure 3:
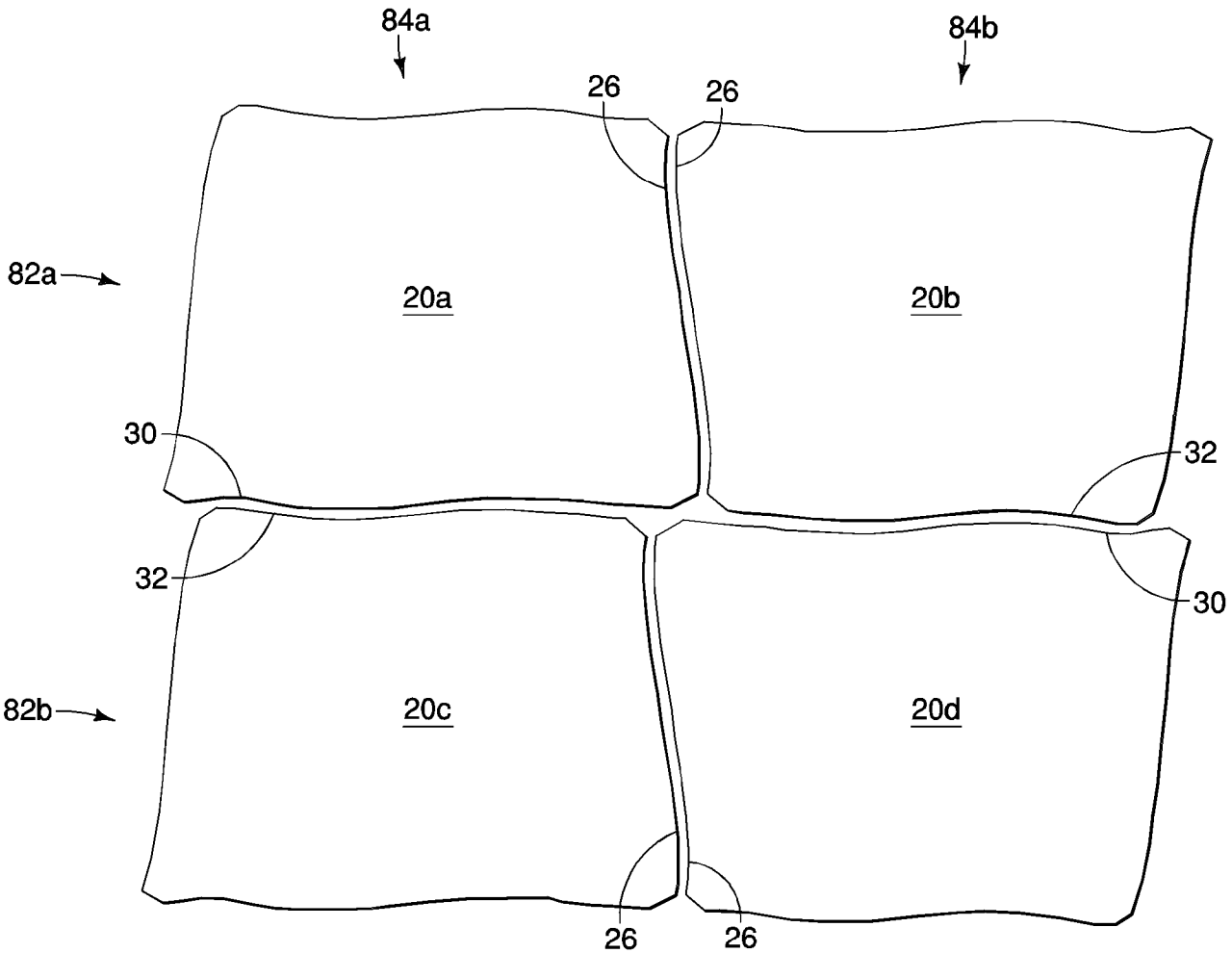
FIG. 3 is a top plan view of four structural wall units according to the first embodiment, illustrating an example alignment of mating sides.

Turning now to the drawings, a first embodiment of a structural unit "unit") 20 is shown in FIGS. 1-3. Multiple units 20 can be used to construct walls as shown for example in FIGS. 8, 10 and 15, single course walls/edgers as shown for example in FIGS. 7 and 11, and other structures. The unit 20 has a generally planar configuration that includes an outer surface. The outer surface includes a top surface 22 and a bottom surface (not shown), which is opposed to the top surface. The bottom surface can be configured similarly or differently to the top surface 22. For example, both the top surface 22 and the bottom surface can be essentially flat, textured, smooth, rounded or partially rounded, or rough. Alternatively, the top surface and the bottom surface can have different configurations. Also, in some embodiments, the top surface 22 may include natural rock features. For the purpose of this application "natural rock features" means joints, cavities, fissures, planar offsets, shale layers, chips and other surface irregularities that singularly or in combination lend a natural rock or stone appearance to the unit. The outer surface of the unit 20 further includes a first side face 26, a second side face 28, a front face 30, and a rear face 32 extending substantially perpendicularly between the top surface 22 and the bottom surface.

In the example unit 20, as best viewed in FIGS. 1 and 3, the first side face 26, the second side face 28, the front face 30, and the rear face 32 together generally define a trapezoid in plan view, as illustrated by dashed lines 33*a*-33*d*. Particularly, the first side face 26 generally defines one leg, the second side face 28 generally defines the other leg, the front face 30 defines a longer base, and the rear face 32 generally defines a shorter base. The outer surface further includes corners 34*a*-34*d* that preferably are not configured to mate with adjacent building units 20. However, it is contemplated that the corners 34 could have a mating configuration.

Each of the first side face 26, the second side face 28, the front face 30, and the rear face 32 have endpoints. First side face 26 extends between points 40*a* and 40*b*. Second side face 28 extends between points 42*a* and 42*b*. Front face 30 extends between points 44*a* and 44*b*. Rear face 32 extends between points 46*a* and 46*b*. Points can also be tangent points where curved or radius corners meet the side, front, or rear general planes. Depending on the overall shape of the unit 20, the length of the unit can be greater than, lesser than, or equal to the depth of the unit. In the unit 20 shown in FIGS. 1-3, the length is greater than the depth.

Each of the first side face 26, the second side face 28, the front face 30, and the rear face 32 has an irregularly shaped contour. For example, each of the first and second side faces 26, 28 define a general S-shape. The S-shape sections of the first and second side faces 26, 28 are translated images of one another to provide mating sides. By "translated image" it is meant that the first and second side faces 26, 28 are substantially copies of one another, each having substantially the same length and configuration. The first side face 26 and the second side face 28 each include an S-shaped section having respective midpoints 48, 49, which are aligned with a centerline.

Midpoint 48 divides the first side face 26 into a first, subtle convex portion 50*a* and a second, subtle concave portion 50*b*. Midpoint 49 divides the second side face 28 into a first, subtle convex portion 52*a* and a second, subtle concave portion 52*b*. Preferably, the S-shaped sections for the first and second side faces 26, 28 are substantially continuous between the end points of the sides, though this is not required. In other embodiments flat portions, subsegments, surface irregularities, or other features could be included as part of an S-curve. In yet other embodiments the S-section can terminate in between, but short of the end points.

The first and second side faces 26, 28 are center rotational images about their midpoints 48, 49. By the term "center rotational image" it is meant that the first portion 50*a* has substantially the same shape or configuration as the second portion 50*b* if the first portion 50*a* was rotated 180 degrees about the midpoint 48. Similarly, for the second side face 28, the first portion 52*a* has the substantially the same configuration a second portion 52*b* if the first portion 52*a* was rotated 180 degrees about the midpoint 49.

Further, in the FIGS. 1-3 embodiment, the front face 30 and the rear face 32 also have a general S-shape. The front surface 30 includes a pair of opposed outer sections 58*a*, 58*b*, as well as a generally central section 60 disposed therebetween. In an example embodiment, the front face center section 60 has substantially the same length and configuration as rear face 32 such that a front face of one unit 20 can mate with a rear face of another like unit 20. In other embodiments, the front faces 30 of adjacent units may only mate with one another, and/or rear faces 32 of adjacent units may only mate with one another. As the outer sections 58*a*, 58*b* preferably are not mating surfaces, they can have any configuration that does not interfere with assembly, as can be seen from example wall embodiments discussed below. It is preferred that the outer sections have a natural appearance.

The central section 60 has a general S-shape that is a center rotational image about a midpoint 62. The midpoint 62 divides the central section 60 into a first, subtle concave portion 64*a* and a second, subtle convex portion 4*b*. Similarly, the rear face 32 has a general S-shape section that is a center rotational image about a midpoint 65. Midpoint 65 is preferably aligned with midpoint 62 along a centerline. The midpoint 65 divides the rear face 30 into a first, subtle convex portion 68*a* and a second, subtle concave portion 68*b*. The S-shaped section of rear face 32 preferably extends between endpoints 46*a*, 46*b*, but in other embodiments can stop short of the endpoints. In a preferred embodiment, the S-shaped section of rear face 32 and the central S-shaped section 60 of the front face 30 are translated images of one another to provide mating sides, though in other embodiments this can vary, as explained elsewhere herein. In the embodiment of FIGS. 1-4, the S-shape sections of the front and rear faces are a different configuration than the S-shape sections of the first and second side faces. However, in alternate embodiments, the S-shaped sections of the front and rear faces can be images of the S-shaped sections of the first and second side faces, whereby a side face of one unit can mate and interlock with either the front or rear face of another like unit. The alternate embodiment where all four side faces include complimentary S-sections can have utility in edger applications.

Though the side faces 26, 28 and in some embodiments the front and rear faces 30, 32 have general S-shape sections, this S-shape need not be the same along the entire surface. For instance, in example embodiments, an upper portion of the side faces 26, 28 or front and rear faces 30, 32 can be sculpted to provide natural rock features, to give the unit a more natural, stone-like appearance, and/or to produce irregular drafted surfaces, as explained further below. In such embodiments, it is preferred that a lower portion of the side faces 26, 28 or front and rear faces 30, 32 near the bottom surface be a "true" representation of the general S-shaped defined by such faces.

Corner portions 34*a*-34*d* can vary in size and shape from corner to corner of a single unit 20, and among multiple units. Since the corners 34*a*-34*d* preferably do not mate, the shape of the corner in such embodiments is immaterial as to how multiple units 20 lay out relative to each other. The corner portions can be substantially flat or smoothly curved. However, it is preferred, though not necessary, that the corner portions 34*a*-34*d* be irregularly configured to exhibit a natural appearance. The respective corners can optionally have different shapes than each other, and can be shaped differently from unit to unit to further enhance a natural appearance in the resulting structure.

Applications of the units 20 include vertical and three-dimensional structures. Such structures can be constructed with different numbers and arrangements of units 20. In the example unit 20, the first side face 26 is configured to mate and interlock side-to-side with the second side face 28 of an adjacent unit in a row when the adjacent unit 20 has the same orientation. Due to the center rotational images, the first side face 26 of one unit 20 also can mate and interlock with an adjacent first side face of another unit, and the second side face 28 can mate and interlock with an adjacent second side face, when the adjacent unit 20 has a reversed orientation.

Similarly, in some example embodiments, the front face 30 (e.g., central section 60) can mate and interlock front-to-back (or back-to-front) with the rear face 32 of an adjacent unit when the adjacent unit has the same orientation in a plane. Due to the center rotational images, the front face 30 of one unit 20 also can mate and interlock with an adjacent front face of another unit. Likewise, the rear face 32 of one unit can mate and interlock with an adjacent rear face of a second unit 20, when the adjacent unit has a reversed orientation. In the example unit 20, neither the front face 30 nor the rear face 32 is configured to interlock with either the first side face 26 or the second side face 28. However, such interlocking can be possible in other embodiments. Further, in some embodiments, the S-shape sections can be the same on the side faces 26, 28 and the front and rear faces 30, 32. In other embodiments, S-shape sections of front and rear faces 30, 32 on a particular unit can be different from one another but similar to faces of other units.

FIG. 3 shows four example units 20*a*, 20*b*, 20*c*, 20*d* that are arranged in two rows 82*a*, 82*b* and two columns 84*a*, 84*b*. The rows 82*a*, 82*b* can be extended to form courses for a structure such as but not limited to a wall. Each of the units 20*a*, 20*c* in column 84*a* is reversed in orientation with respect to the units 20*b*, 20*d* in column 84*b*. In this way, the units 20*a*, 20*b* in row 82*a* align along a substantially straight line, as do the units 20*c*, 20*d* in row 82*b*. Other courses can be curved or have a complex shape.

Figure 11:
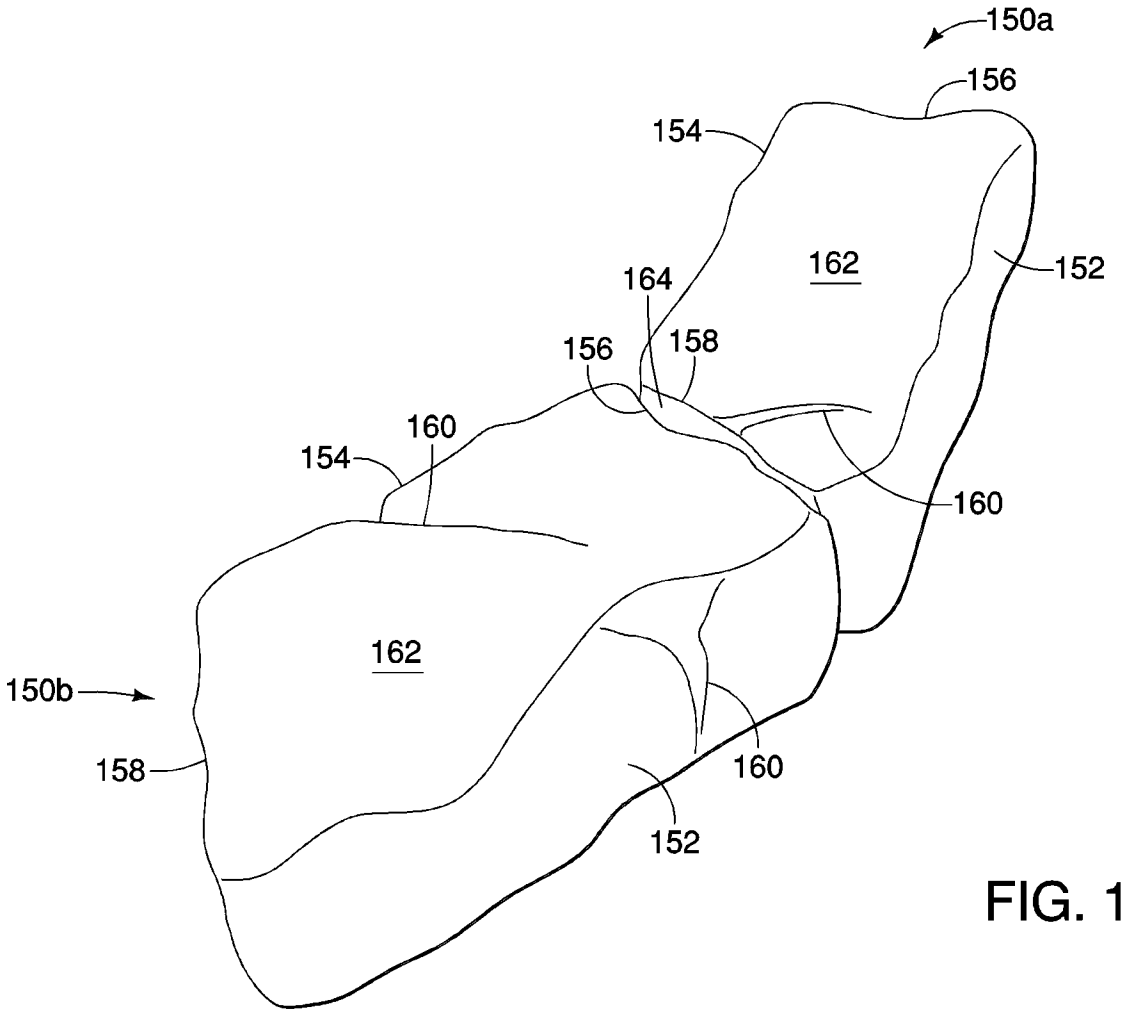
FIG. 11 is a perspective view of a structural wall unit according to a fourth embodiment of the invention, in which fissures are provided on a front face and top surface of the unit.
Figure 16:
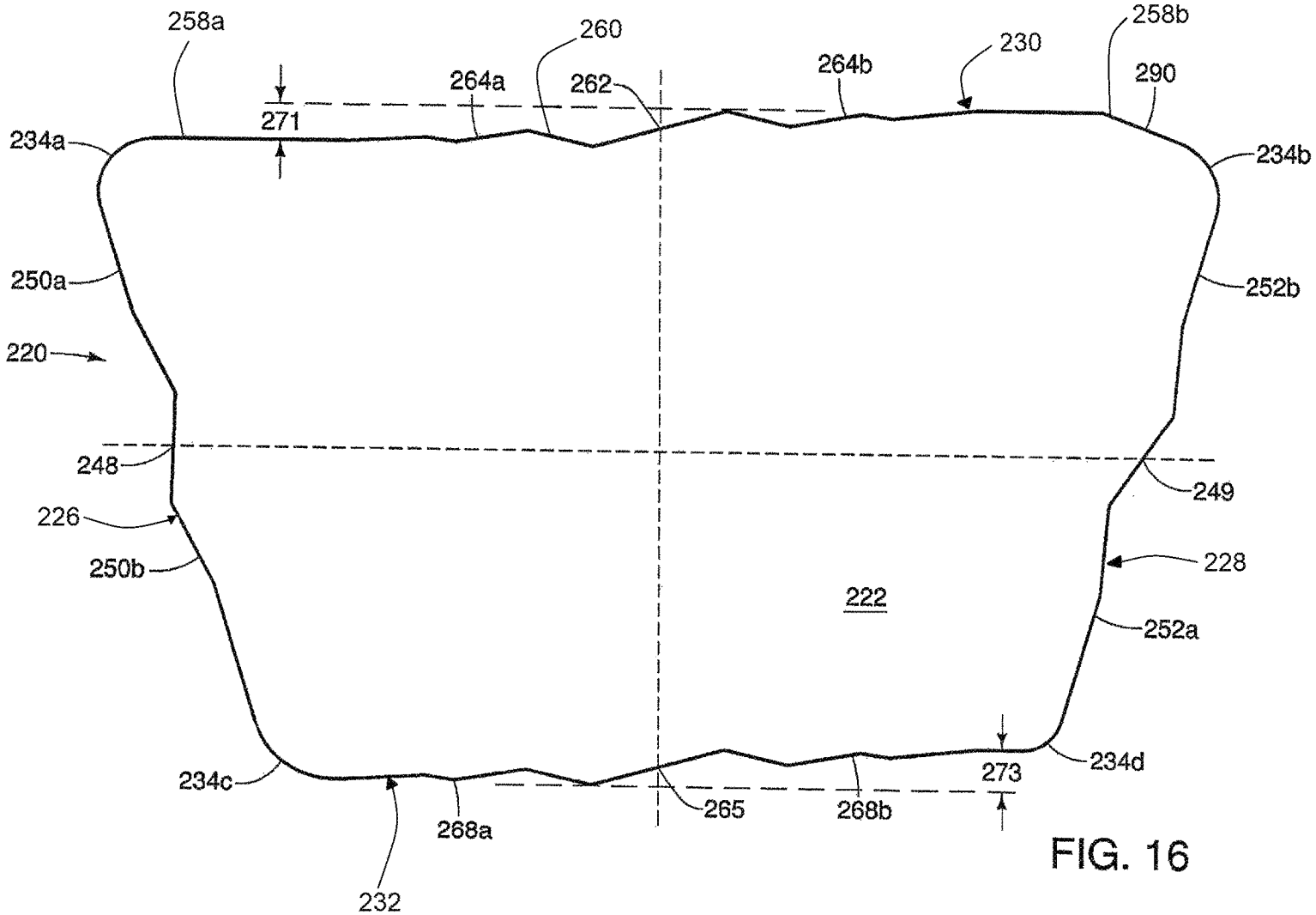
FIG. 16 is a top plan view of a structural wall unit according to a sixth embodiment of the invention.

In the example arrangement of FIG. 3, the first side face 26 of unit 20*a* is adjacent to the first side face 26 of unit 20*b*, and the first side face 26 of unit 20*c* is adjacent to the first side face 26 of unit 20*d*. Additionally, the front face 30 of unit 20*a* is adjacent to the rear face 32 of unit 20*c*, and the rear face 32 of unit 20*b* is adjacent to the front face 30 of unit 20*d*. Additional units can be included in this arrangement, in which the units in each row are reversed in orientation with respect to each other, and the units in each column have the same orientation as each other. In other arrangements, as shown in FIG. 11 for example, two or more units in a row can have the same orientation, thereby causing the course to angle. In yet other arrangements, such as shown in FIG. 16 for example, the front faces can be aligned, and the rear faces can be aligned.

Units 20 optionally can be provided with irregular surface features to provide aesthetic benefits. Any of the faces 26, 28, 30, 32 can be smooth or textured, e.g., to facilitate a natural appearance. The front face 30, rear face 32 and portions of the top face 22 can include natural rock features. The units thereby appear more like natural stone, which helps disguise the trapezoidal configuration and functional S-shaped mating sections.

Example units 20 or other example units can be used in any of various courses, wall sections and walls. Units with raked, scraped, roughed or irregularly molded surfaces can be used as edgers with mating and aligning end surfaces. A stone-like appearance, with false joint on top and/or on any of the front, rear, first side, and/or second side surfaces, can also be provided in example embodiments. Unit uses include, but are not limited to, retaining walls, exterior and interior building blocks, wall tile, and column blocks. An overall structure can have an appearance of being custom built. Further, when the units 20 are aligned along a surface, adjacent faces can interlock due to the mating configurations of the first and second side faces 26, 28, and in some embodiments, the front and back faces 30, 32. Interlocking can occur both longitudinally and transversely.

Such interlocking can provide significant structural benefits. For instance, interlocked side-to-side units 20 in courses are less likely to separate from the course when pushed outwardly under load. This interlocking is also useful, for instance, during manufacture of units, in which pallet loads of multiple units can be arranged and transported by a cuber. The front-to-back and side-to-side interlocking units 20 reduce separation of individual units from the pallet load during lifting or other moving, and assist in creating a tight shipping pallet where face rubbing is reduced during transport.

To further enhance the natural appearance of wall structures made with example units 20, it is also possible that any of first and second sides 26, 28 and front and rear faces 30, 32 match less than perfectly, i.e., that a non-substantial gap is formed between adjacent units, and that the gap can vary in thickness. This is preferably accomplished by introducing minor variations in the faces 26, 28, 30, 32 so that the surfaces are not identical. However, it is preferred that the surfaces mate and interlock. "Mate" generally refers to fitting or associating suitably. "Interlock" does not necessarily mean that surfaces are touching (though they can be), but refers more generally to the faces having at least two separate points that when shifted a direction parallel to the general direction of the face will contact points along an adjacent face thereby resisting or limiting transverse movement between units.

The units 20 can be made of concrete, stone, ceramics, plastic, or other suitable materials, or combinations thereof. Such units 20 can be made in any conventional manner, for example by molding. Two example molding methods are dry cast and wet cast. Dry cast material can be used to mass manufacture low cost units. Wet cast is more expensive, but produces very high quality units, with clearly defined natural stone appearance.

In the wet cast process, a form is constructed with side walls conforming to the planar configuration of the unit 20 with a bottom of the form designed to mold what will be the faces 26, 28, 30, 32 or top surface 22 of the unit 20. The unit 20 is molded upside down by pouring a concrete mixture into the form and allowing it to cure. An advantage of the wet process is that natural stone materials and other desirable additives may be introduced that are not compatible with mass production by the dry cast process. The bottom surface is typically not textured in wet or dry cast processes, although these surfaces could be textured in process through the use of inserts.

In an example dry cast process, a semi-dry mixture (e.g., about 5% moisture) is poured into a mold, for instance within a frame having several molds defined by panels. A support table is provided underneath the mold, and a tamper head shoe assembly compacts the dry mixture. The unit is extracted from the mold(s) by lowering the table or raising the mold body. For units having irregular features, it can be difficult to extract the unit from the mold without removing mold sidewalls.

To provide a more natural rock-like appearance, and to assist in extracting units from the mold, the sides of the unit are preferably drafted, i.e., the sides taper inwardly and progressively from bottom to top (based on the orientation of the unit in the mold). However, the entire outer periphery of the unit need not be drafted. Some portions or areas can be plumb. In the drafted portions, the degree of taper can vary in an irregular manner, both vertically and horizontally. Fissures, ledges, recesses and other natural rock features can be sculpted in the molds so the sides appear rock-like, as shown for example in FIGS. 11-12 and 15. See also, U.S. Design Pat. No. D674,510, which is hereby incorporated by reference. This side molding feature is referred to herein as an "irregular draft" or as being "irregularly drafted." In other embodiments, one or more faces, or portions thereof, can be plumb, i.e., orthogonal or generally orthogonal with the bottom face of the unit.

Figure 4:
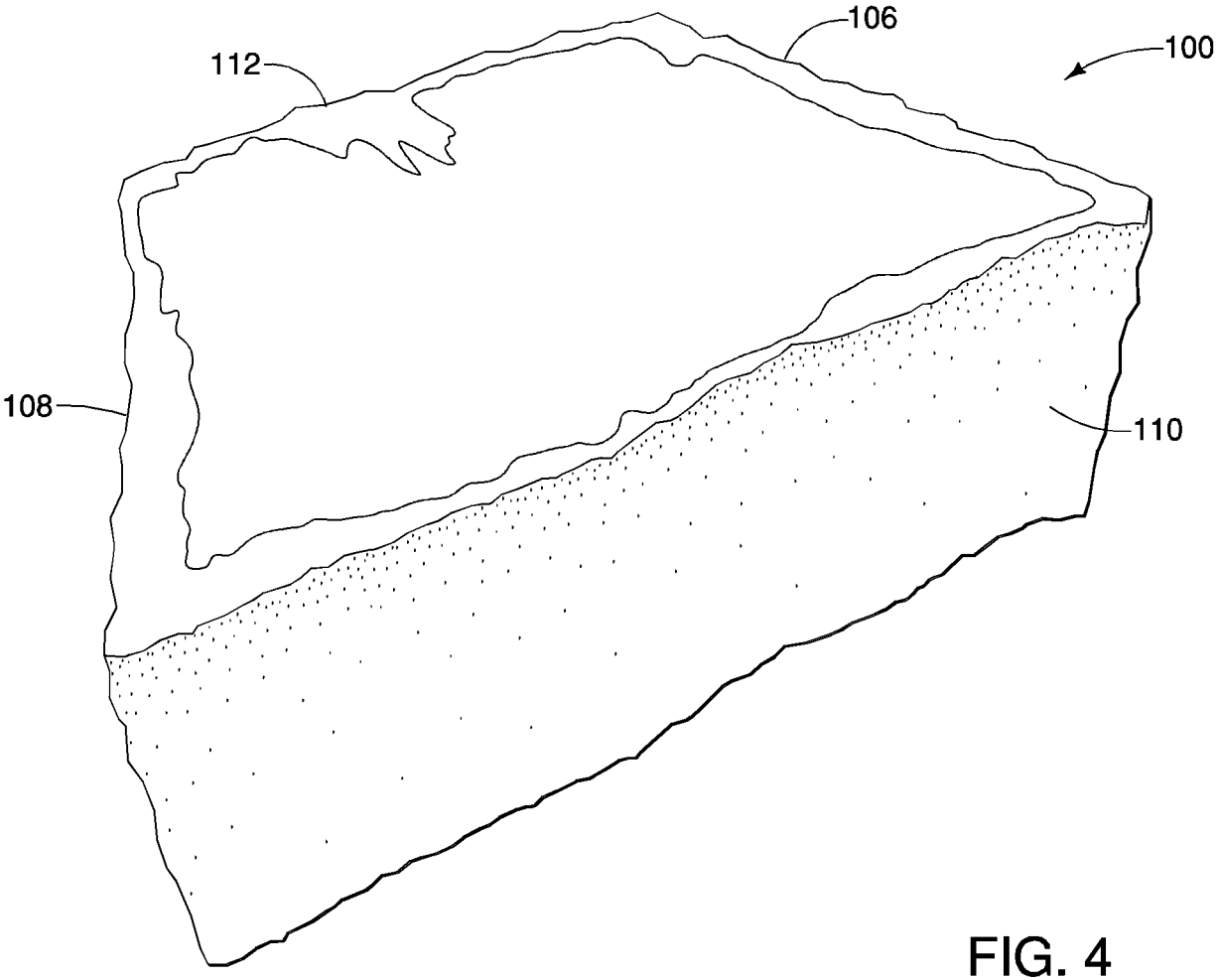
FIG. 4 is a front perspective view of a second embodiment structural wall unit, illustrating an irregularly drafted front mating side.
Figure 5:
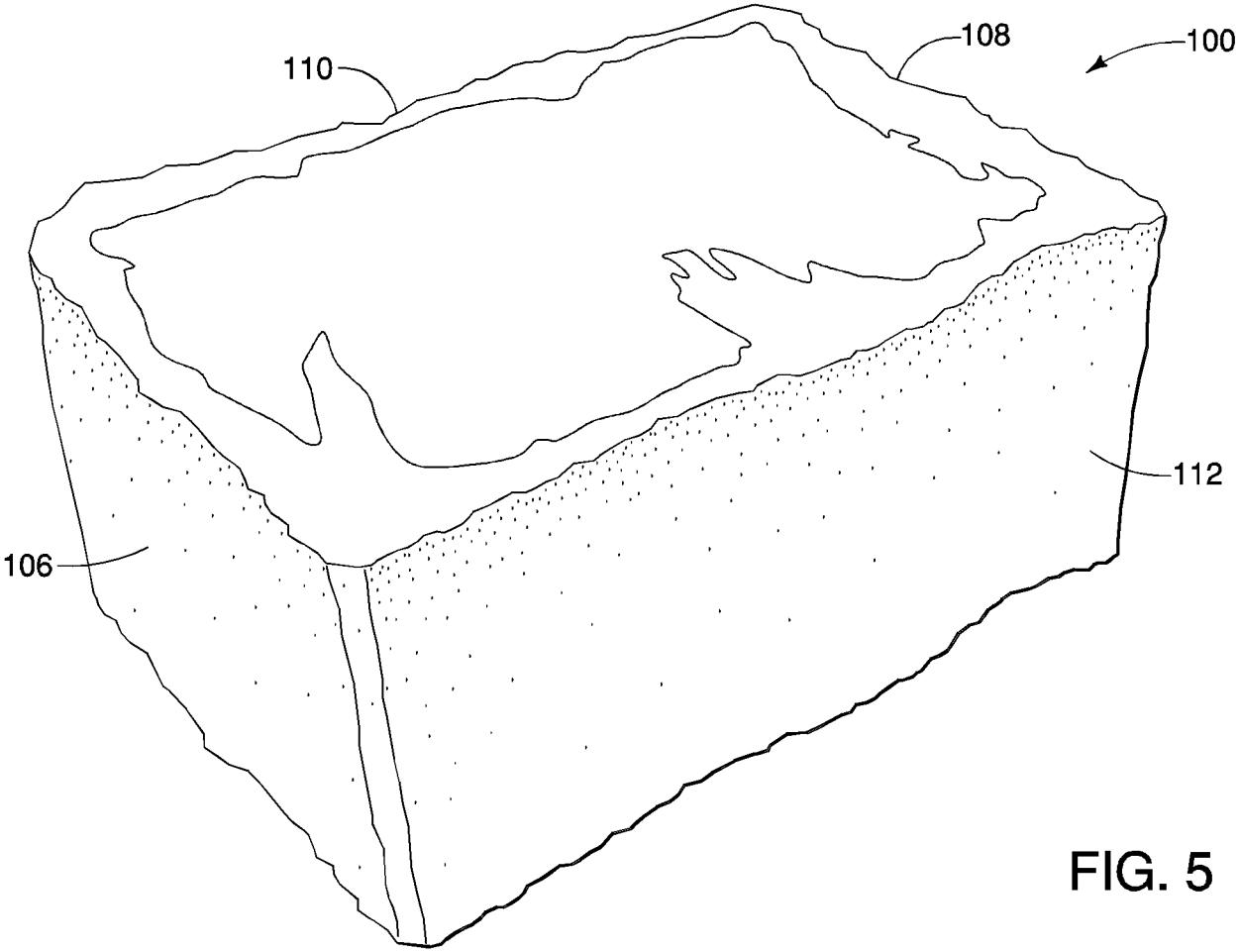
FIG. 5 is a rear perspective view of the second embodiment structural wall unit, illustrating an irregularly drafted rear mating side.
Figure 6:
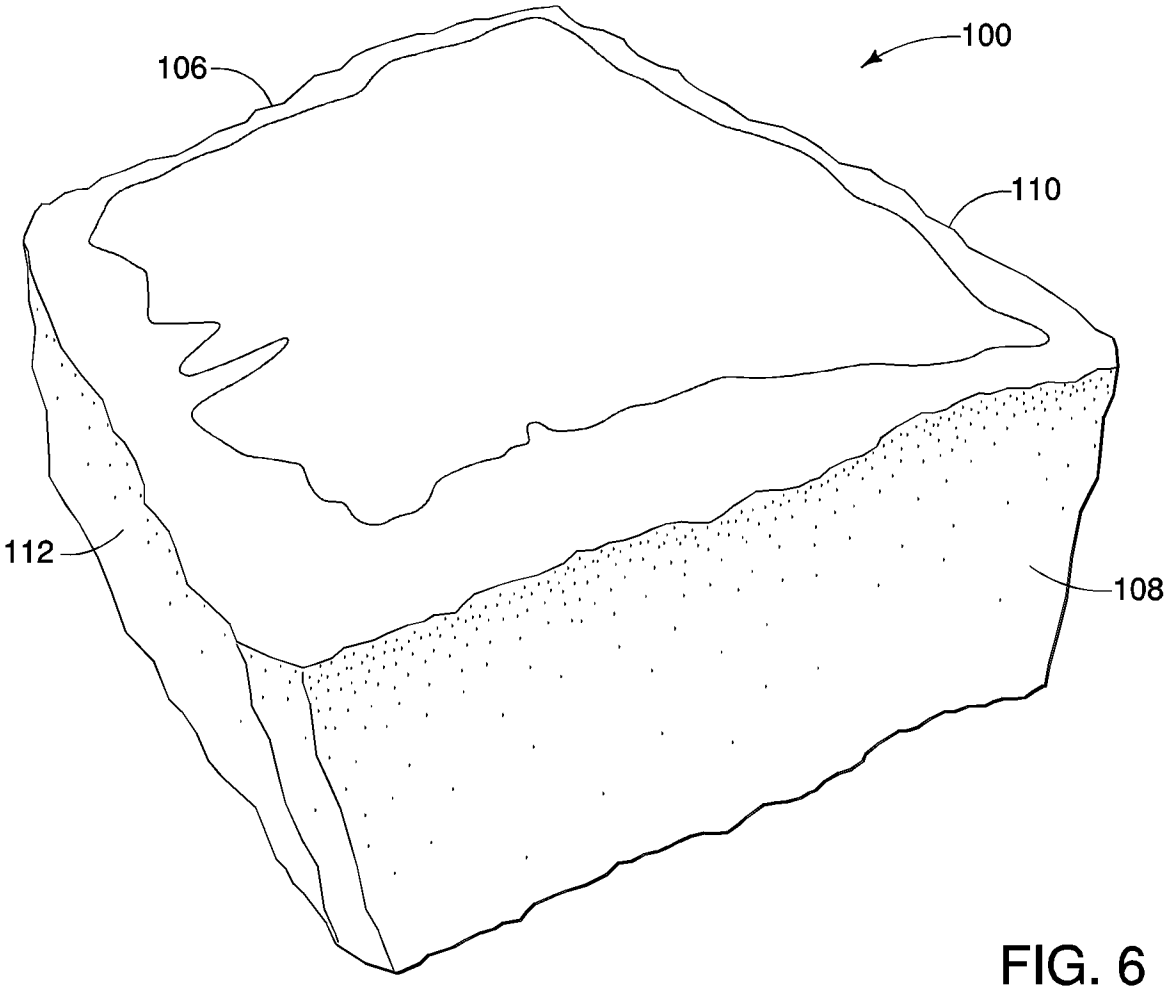
FIG. 6 is a side perspective view of the second embodiment structural wall unit, illustrating an irregularly drafted mating side.

A particular example unit 100, shown in FIGS. 4-6, is configured similarly to the unit 20, but is irregularly drafted, such that faces 106, 108, 110, 112 taper from top to bottom. For example, drafted forms can be sculpted to impart irregular sub-surfaces, valleys, ridges, etc, can be provided. In other embodiments, false joints can be provided to make the unit appear more natural. Drafting the sides of the forms assists extraction of the unit 100 from the mold, even with irregular features molded into the unit. The particular drafting along each of the faces 106, 108, 110, 112 can vary. The irregular drafting can provide a more natural rock-like appearance.

Figure 7:
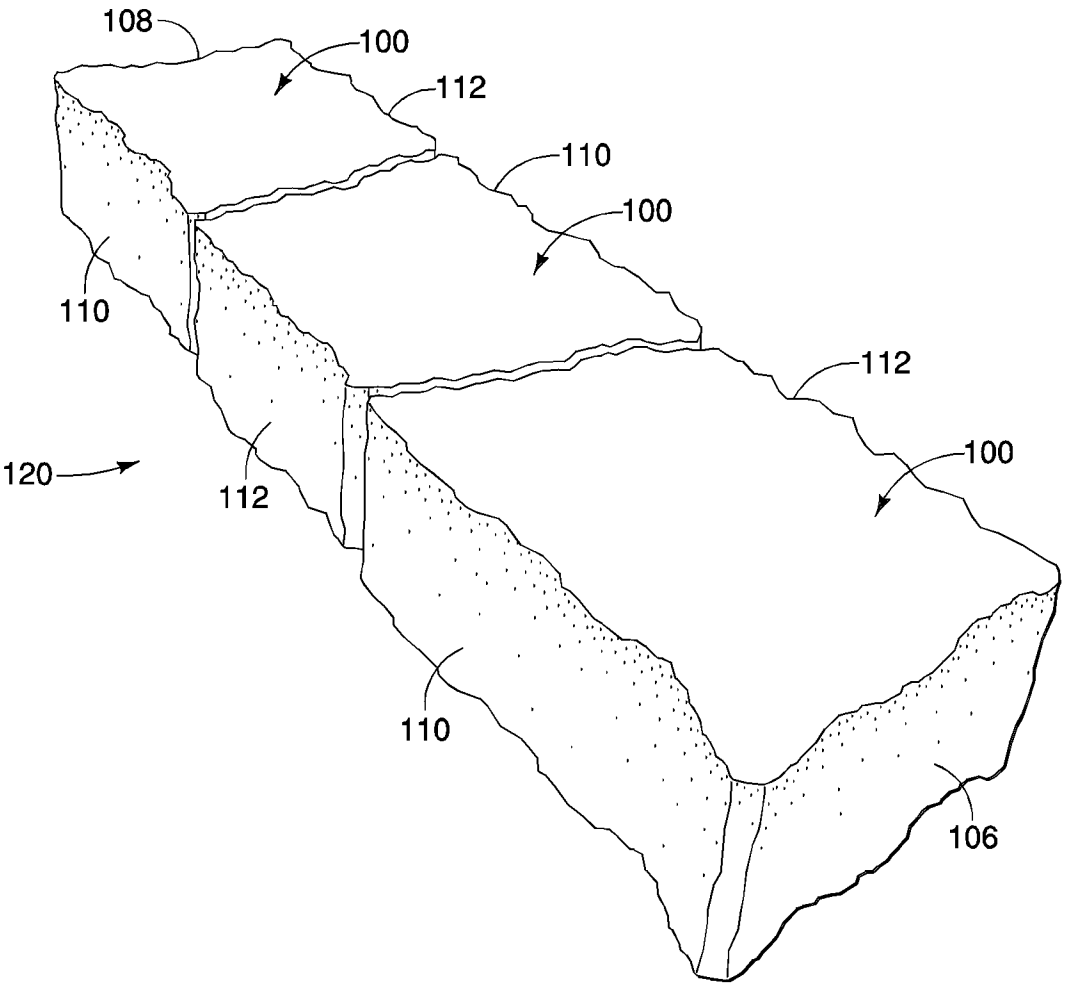
FIG. 7 is a perspective view of a partial course of second embodiment structural wall units arranged end to end in a straight line, with adjacent units reversed in orientation along a plane.
Figure 8:
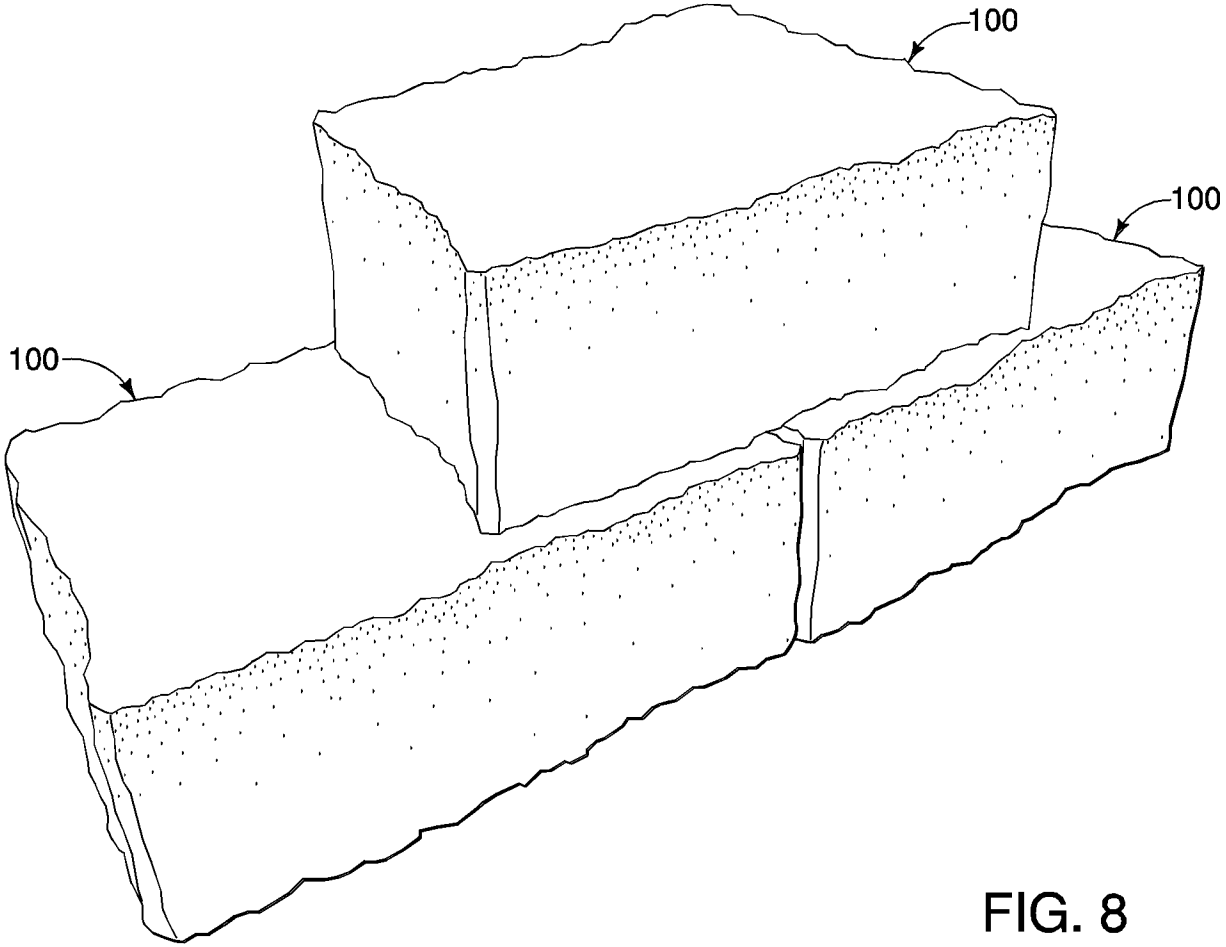
FIG. 8 is a perspective view of a partial wall structure including two partial courses of second embodiment structural wall units.
Figure 9:
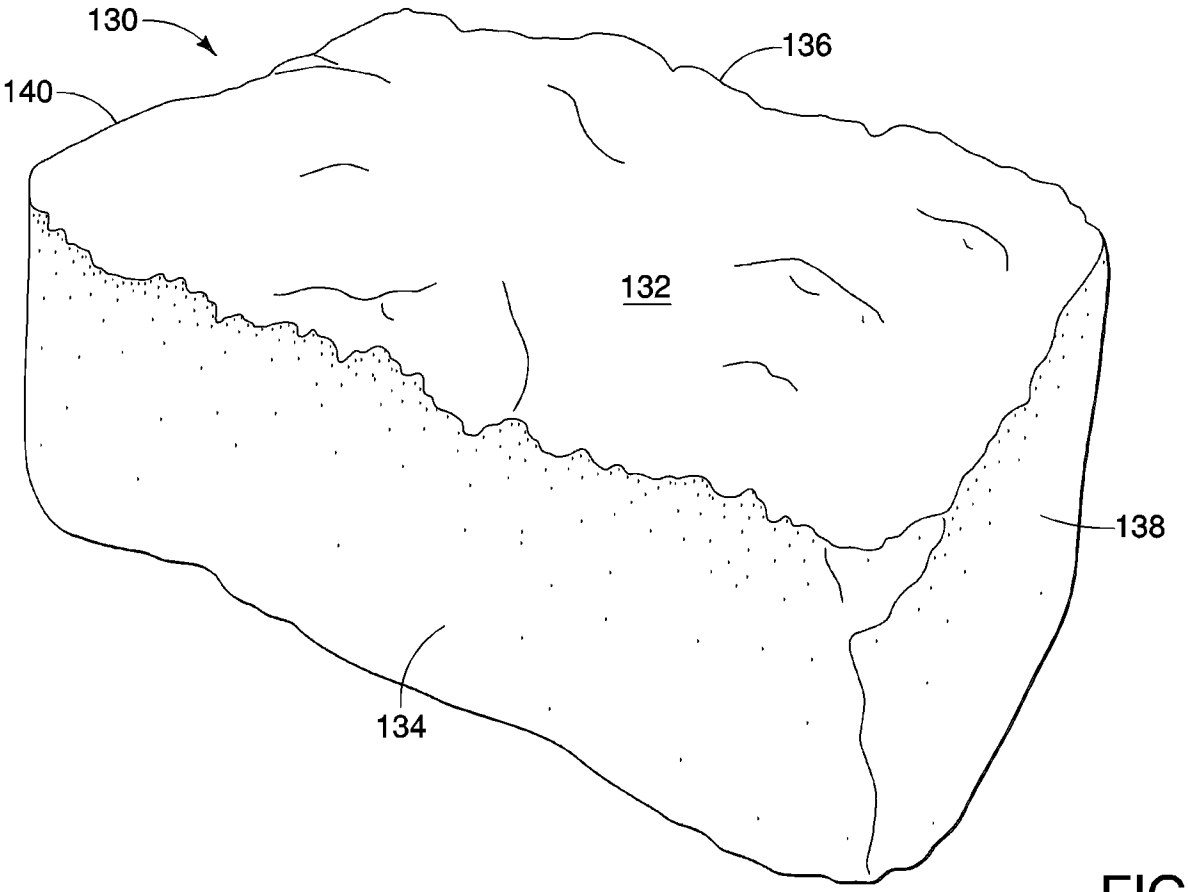
FIG. 9 is a perspective view of a structural wall unit according to a third embodiment of the invention having a rounded, natural stone appearance, and in which a front face is irregularly drafted.
Figure 10:
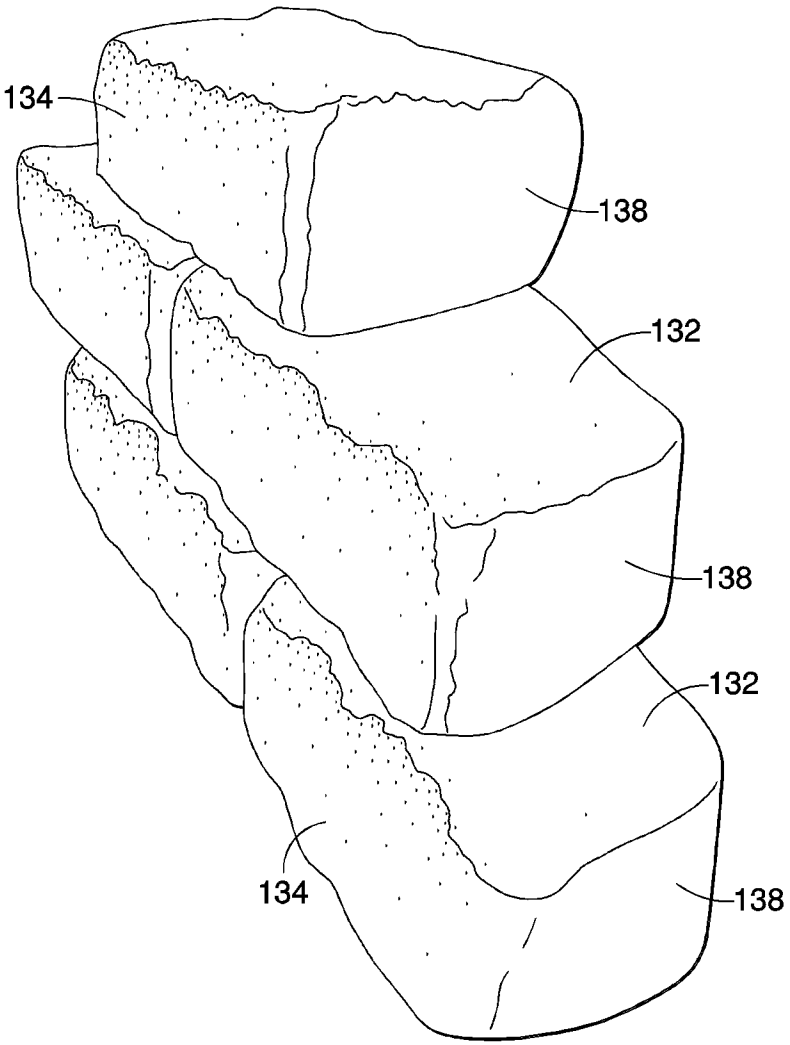
FIG. 10 is a perspective view of a partial wall structure including three partial courses of third embodiment structural wall units.

FIG. 7 shows an example course 120 including three units 100 arranged end to end in a line, in which adjacent units are reversed in orientation. The front faces 106, rear faces 108, and first and second side faces 110, 112 are irregularly drafted. FIG. 8 shows two bonded courses of three units 100. The second course is set back relative to the first course. In alternate embodiments, the units can further comprise features and/or devices for generating setbacks, aligning units, and mechanically connecting units, including cores, holes, pins, cavities, slots, mating tongue/groove patterns, mechanical fasteners, etc., as shown for example in U.S. Pat. Nos. 6,615,561, 6,447,213, 6,854,231, and 7,168,892, which are hereby incorporated by reference. FIGS. 9-10 show a unit 130 (FIG. 9) and three bonded courses of units (FIG. 10) according to another embodiment of the invention. In the unit 130, a top surface 132, a bottom surface (not shown), a front face 134, a rear face 136, a first side face 138, and a second side face 140 have a rounded, natural stone appearance. Faces 134, 136, 138, 140 are irregularly drafted. In addition to being roughened and textured, example units can be tumbled to remove mold and pallet marks and otherwise smooth details, as shown for instance in the units 130 of FIGS. 9-10.

FIG. 11 is a perspective view of structural wall units 150*a*, 150*b* according to another embodiment of the invention. In these units, front and back faces 152, 154, and side faces 156, 158, have a general S-shape. Units 150*a* and 150*b* have the same (not reverse) orientation, whereby first side face 156 of unit 50*b* is mated with second side 1158 of unit 150*a*, whereby the units from angle with respect to each other. Fissures 160 are provided on the front face 152, and extend over a top surface 162 of the unit. A top part of the mating faces 156, 158 is pulled back (drafted) from the plan view mating line between the units 150*a*, 150*b*, providing an irregular gap 164 between units at the top surface, above a base mating line.

Figure 12:
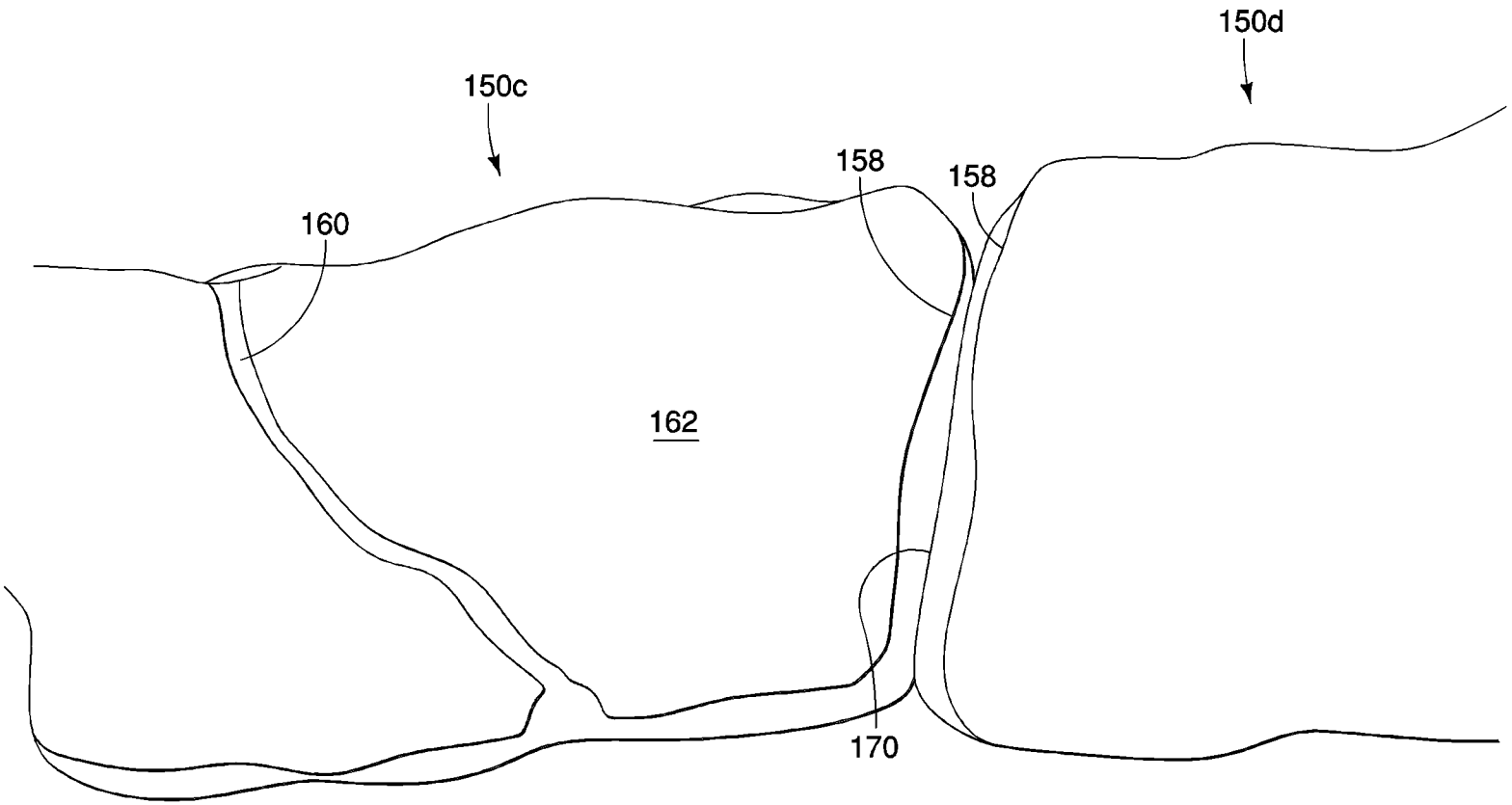
FIG. 12 is a top plan view of two mating units according to the fourth embodiment, illustrating an irregular width gap between the adjacent units due to drafted side faces.

FIG. 12 is a top plan view of two adjacent units 150*c*, 150*d*. An irregular width gap 170 is provided between the units due to drafted side faces 158.

Figure 13:
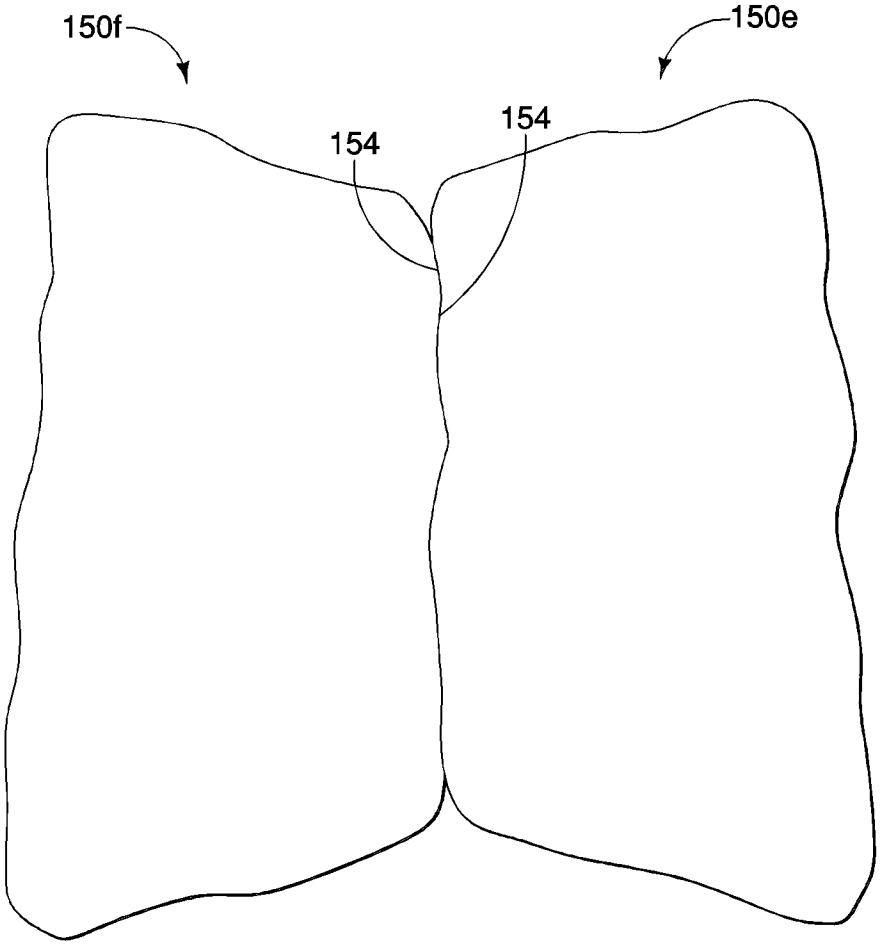
FIG. 13 is a bottom plan view of two mating units according to the fourth embodiment, illustrating how units with drafted faces can mate closely at the bottom.

FIG. 13 is a bottom plan view of two mating units 150*e*, 150*f* in which back faces 154 are adjacent. Due to the general S-shape configuration, the units 150*e*, 150*f* mate closely at the base of the unit.

Figure 14:
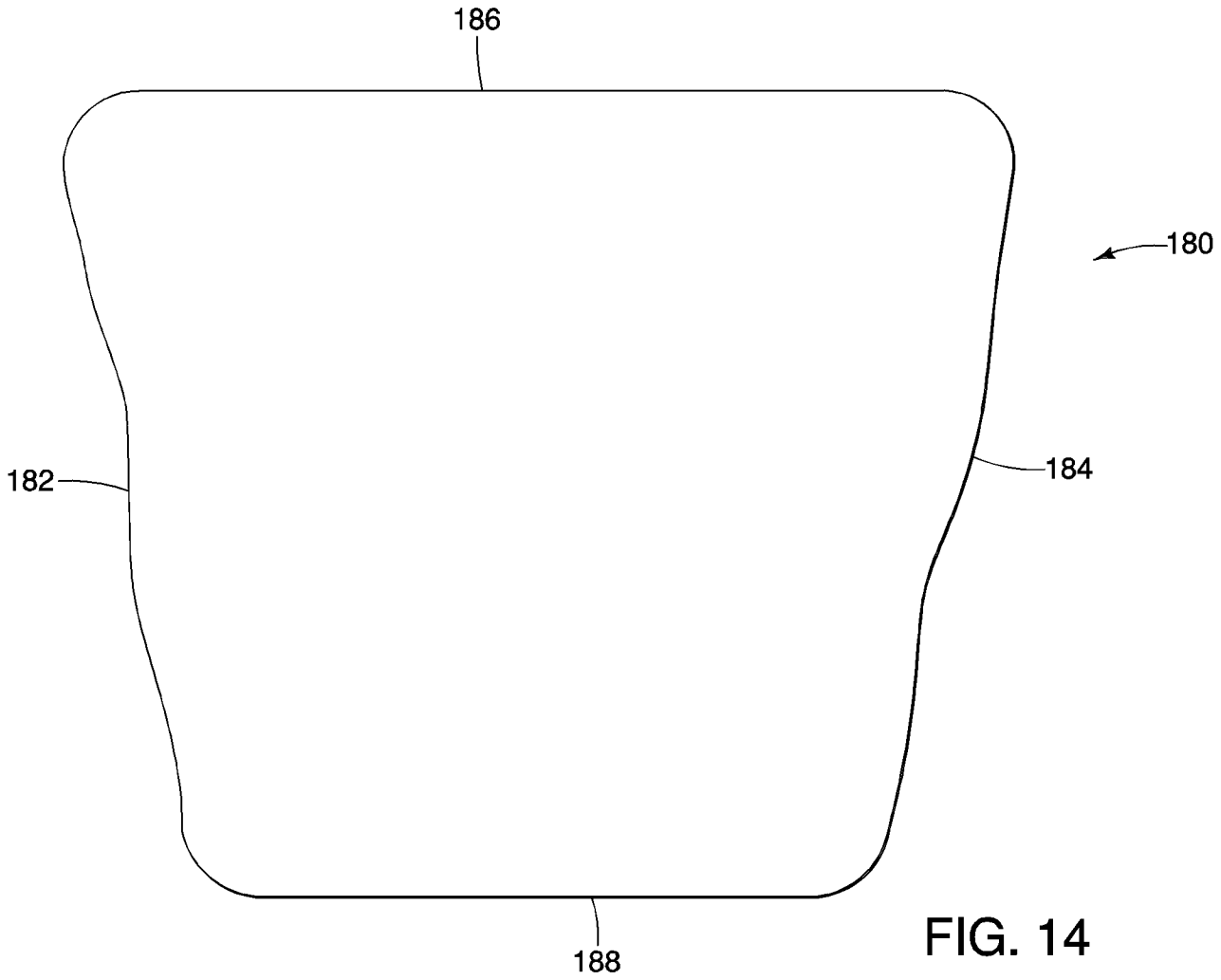
FIG. 14 is a top plan view of a structural unit according to a fifth embodiment of the invention, in which first and second sides have a general S-shape, and front and back faces are substantially flat.
Figure 15:
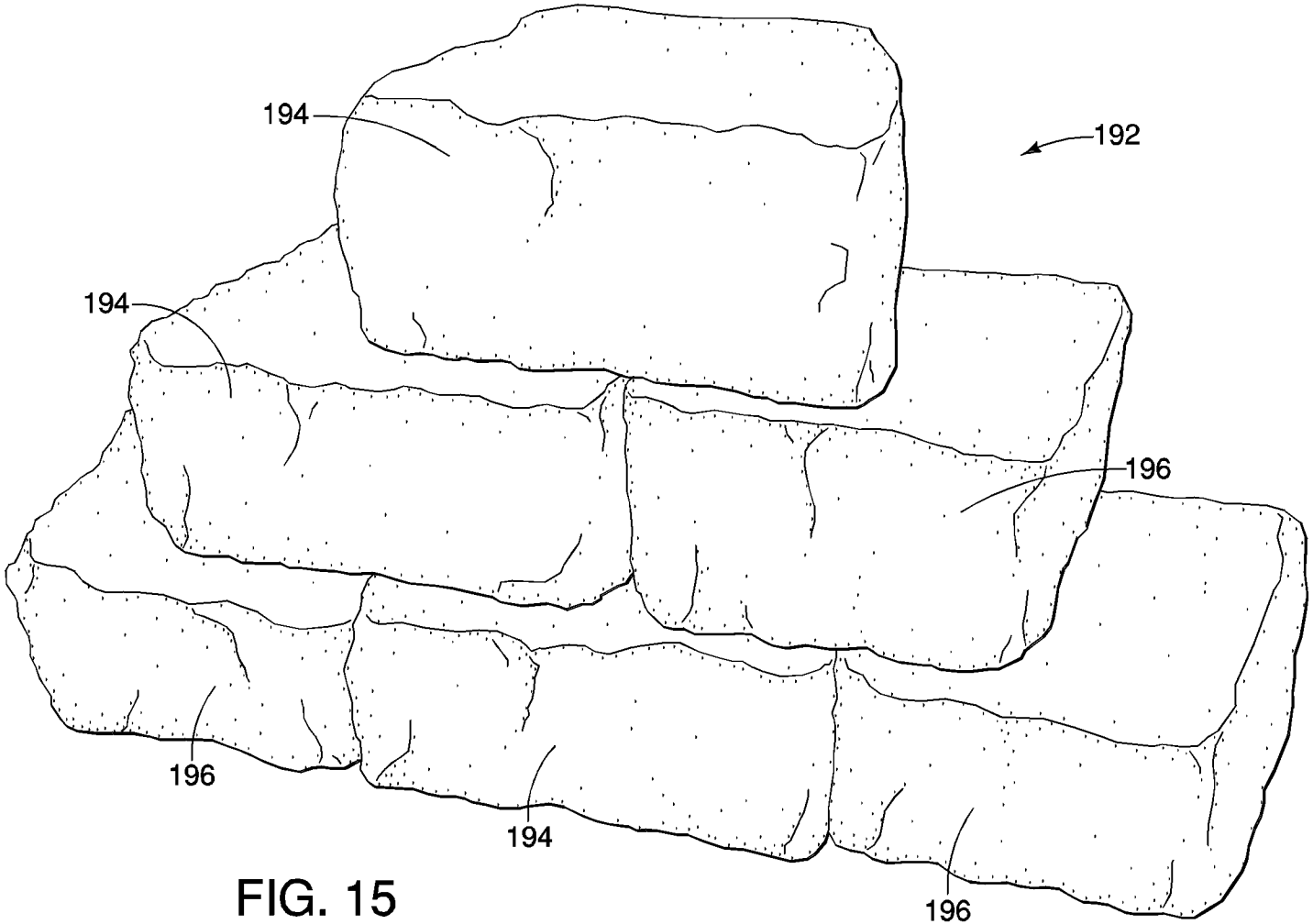
FIG. 15 is a perspective view of a plurality of structural units according to a sixth embodiment of the invention, in which first and second sides have a general S-shape, and faces have a scraped surface to provide a more natural appearance.

FIG. 14 is a top plan view of a structural unit 180 according to another embodiment of the invention, in which first and second sides 182, 184 have a general S-shape, and front and back faces 186, 188 are substantially flat. The front and back faces 186, 188 can be irregularly drafted, and can have fissures and/or be roughened, or otherwise textured to provide a more natural appearance. For example, FIG. 15 shows a plurality of arranged units 192 similar to unit 180, in which faces are roughened or otherwise textured. The units 192 alternate in front side 194 and back side 196 orientation, and the courses are laid in a running bond, as illustrated.

Figure 17:
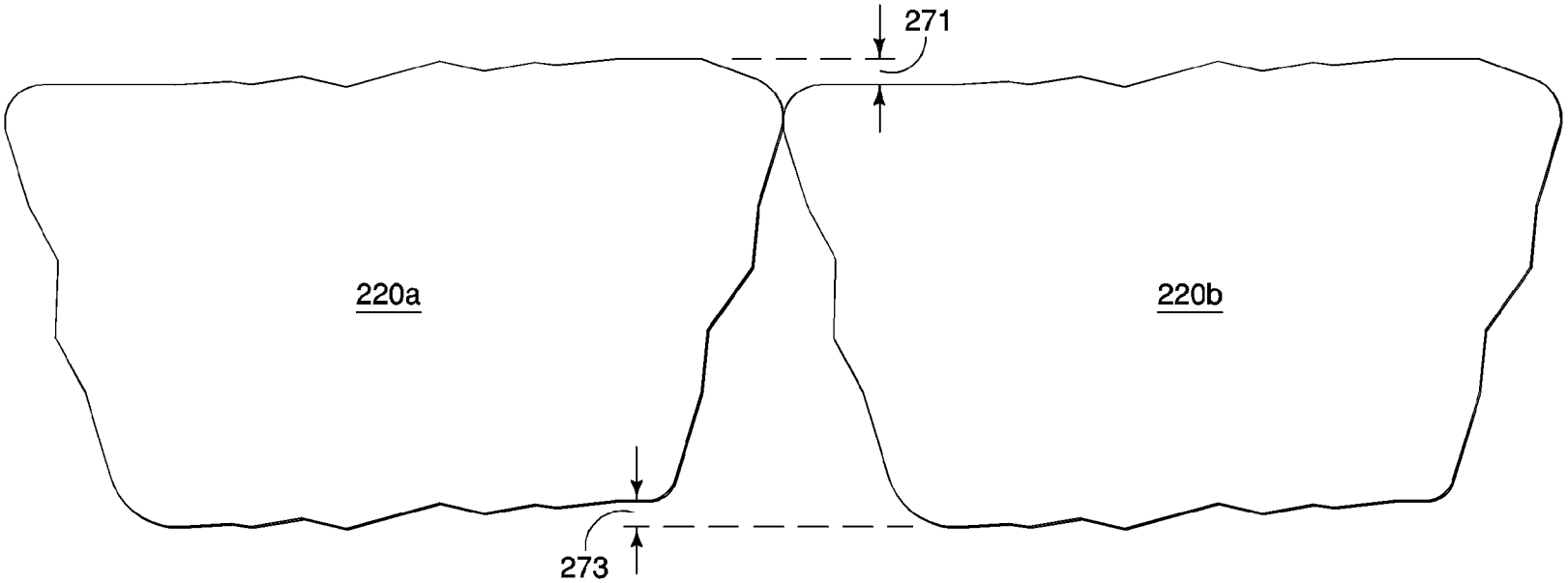
FIG. 17 is a top plan view of two side-by-side units of the sixth embodiment.
Figure 18:
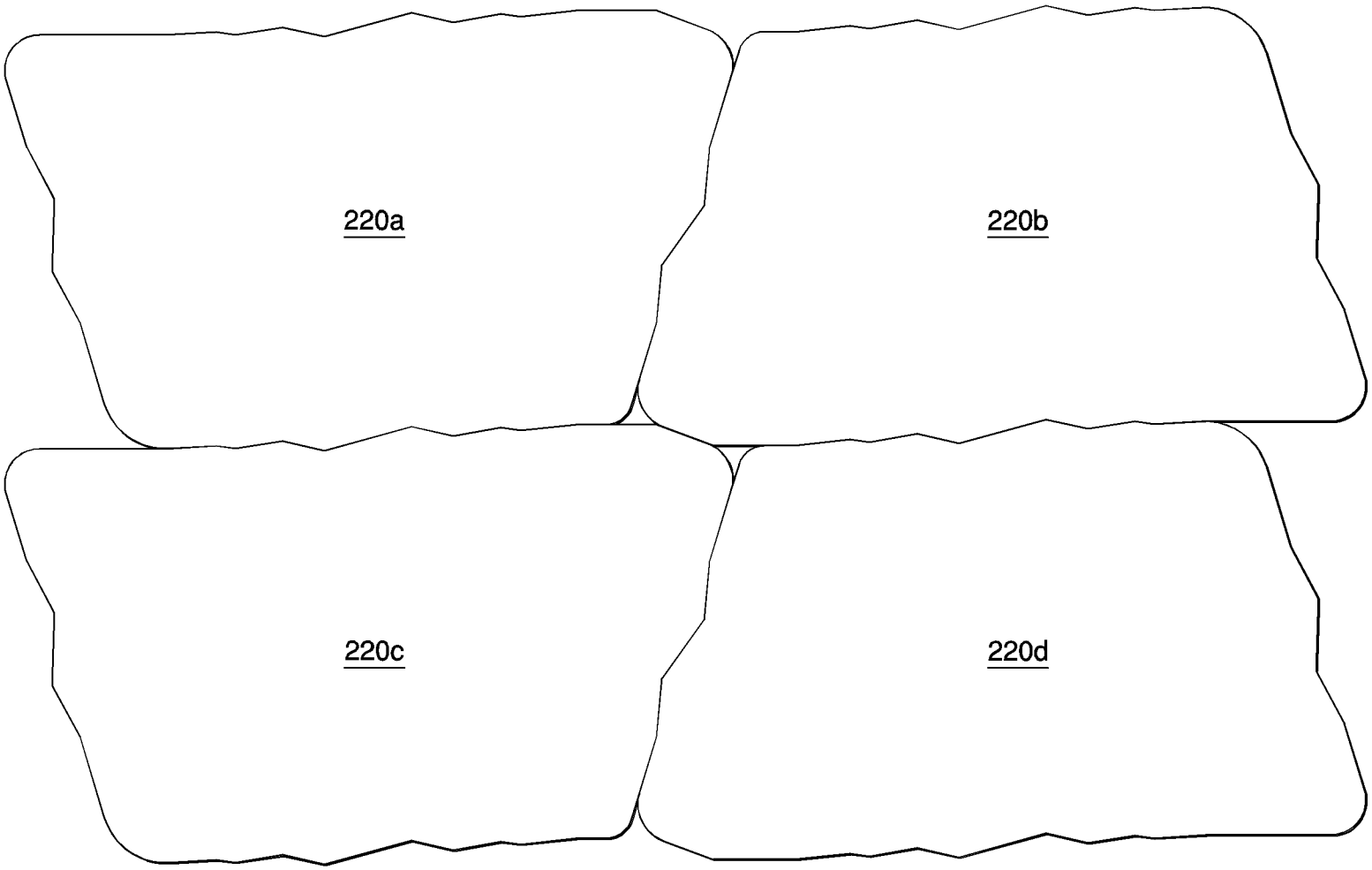
FIG. 18 is a top plan view of four structural wall units according to the sixth embodiment, illustrating an example alignment of mating sides.

FIGS. 16-18 illustrate a sixth embodiment of a structural wall unit 220. The reference numbers for the sixth embodiment are the same as for the first embodiment, but within the 200 number series. Unit 220 includes a top surface 222, a first side face 226, a second side face 228, a front face 230, and a rear face 232 that together generally define a trapezoid in plan view. The outer surface further includes generally rounded corners 234*a*-234*d* that preferably are not configured to mate with adjacent building units. FIG. 17 shows two side-by-side structural wall units 220*a*, 220*b*. FIG. 18 shows four structural wall units 220*a*, 220*b*, 220*c*, 220*d*, illustrating alignment of mating sides.

Each of the first side face 226, the second side face 228, the front face 230, and the rear face 232 has an irregularly shaped contour. The first and second side faces 226, 228 include a general S-shape section. The S-shape sections of the first and second side faces 226, 228 are translated images of one another to provide mating sides. A midpoint 248 divides the first side face 226 into a first, subtle convex portion 250*a* and a second, subtle concave portion 250*b*. Midpoint 249 divides the second side face 228 into a first, subtle convex portion 252*a* and a second, subtle concave portion 252*b*. The first and second side faces 226, 228 are 180 degree center rotational images about their midpoints 248, 249, respectively.

Further, in the FIGS. 16-18 embodiment, the front face 230 and the rear face 232 also include a general S-shape section. The front surface 230 includes a pair of opposed outer sections 258*a*, 258*b*, as well as a generally central section 260 disposed there between. The front face center section 260 has substantially the same length and configuration as rear face 232 such that a front face of one unit 220 can mate with a rear face of another like unit 220. As the outer sections 258*a*, 258*b* preferably are not mating surfaces, they can have any configuration that does not interfere with assembly.

The central section 260 has a general S-shape that is a center rotational image about a midpoint 262. The midpoint 262 divides the central section 260 into a first, subtle concave portion 264*a* and a second, subtle convex portion 264*b*. Similarly, the rear face 232 has a general S-shape section that is a center rotational image about a midpoint 265. The midpoint 265 divides the rear face 230 into a first, subtle convex portion 268*a* and a second, subtle concave portion 268*b*. The S-shaped section of rear face 232 and the central S-shaped section 260 of the front face 230 are translated images of one another to provide mating sides.

As shown in FIGS. 16 and 17, one portion 264*b* of front face 230 extends outwardly a greater distance than the other portion 264*a*, providing an offset 271. Preferably a transition portion 290 is provided so that corner portion 234*b* has a similar orientation relative to corner 234*a*. Similarly, one portion 268*a* of the rear face 232 extends outwardly a greater distance than other portion 268*b*, providing a similar, translated offset 273. The front and back offsets enhance the engagement and interlocking functions between the units, as shown for example in FIG. 18. They also enhance the natural, non-geometric appearance of the unit and resulting structure.

Figure 19:
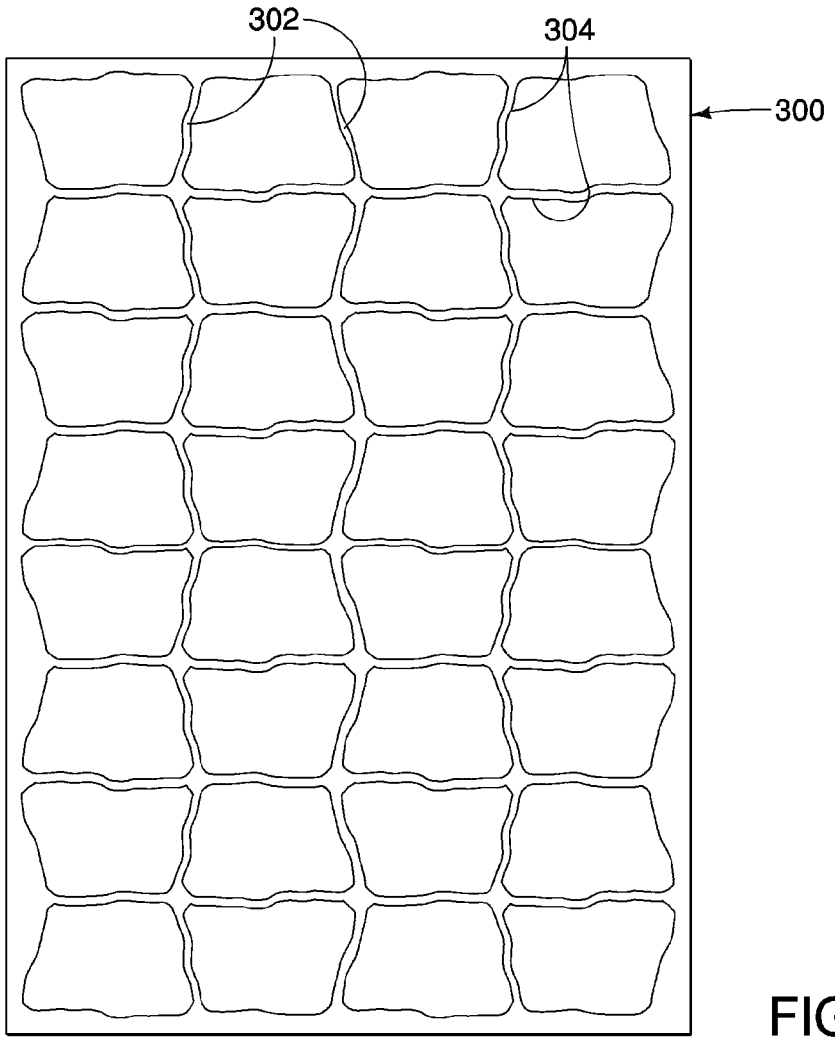
FIG. 19 is a top plan view of an example mold box for structural wall units.

FIG. 19 is a top plan view of an example mold box 300 for structural wall units. A unit division liner 302 is provided inside mold box 300 forming multiple unit cavities 304. The mold box 300 can be manufactured using materials and methods that will be appreciated by those of ordinary skill in the art. Portions of inner walls of the mold box and division liner extend inwardly to provide drafted faces as well as variations (e.g., false joints, fissures, recesses, etc.)

that are preferably also drafted. A mold shoe (not shown) can be sculpted as well to impress variations (e.g., false joints, fissures, recesses, etc.) onto the top surface of the units in the molding process. The irregular drafted features can also be carried over into the top surface of the unit as shown in FIGS. 11 and 12.

Figure 20:
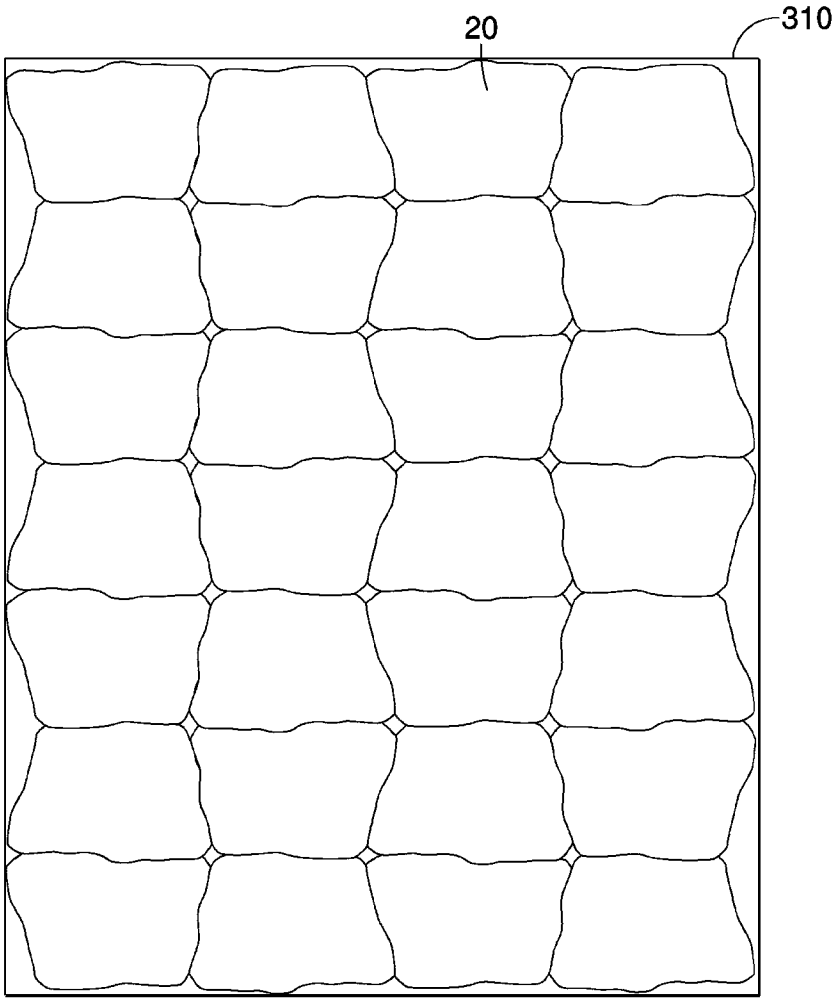
FIG. 20 is a top plan view of a pallet layout including rows and columns of adjacent structural wall units.

FIG. 20 is a top plan view of an example unit layout for a pallet 310 including rows and columns of adjacent structural wall units, such as units 20. As explained above, the mating faces side-to-side, back-to-back and front-to-front interlock the units on the pallet, restrict relative movement between units, and thereby minimize damage during transportation.

While preferred embodiments of the structural wall unit and wall structures have been herein illustrated and described, it is to be appreciated that certain changes, rearrangements and modifications may be made therein without departing from the scope of the invention.

What is claimed is:

1. An irregular trapezoidal structural unit configured to be arranged with other like units in courses to form a structure, the unit comprising:

an upper surface and a lower surface, the lower surface being opposed to the upper surface; a front face and an opposed rear face disposed between the upper surface and the lower surface, the front face being longer than the rear face, the front and rear faces having an irregular configuration; a first side face and an opposed second side face disposed between the upper surface and the lower surface, wherein both the first side face and the second side face generally extend inwardly in plan view from the front face to the rear face;

wherein the first side face and the second side face each include a general S-shape section;

wherein the S-shape section of the first side face and the S-shape section of the second side face each are center rotational images; and wherein the S-shape section of the first side face is a translated image of the S-shape section of the second side face such that the first side of said unit will mate with either a first or second side face of another like unit and the second side face of said unit will mate with either a first or second side face of another like unit;

wherein the front face and the rear face each include a general S-shape section;

wherein the S-shape section of the front face and the S-shape section of the rear face each are center rotational images; and wherein the S-shape section of the front face is a translated image of the S-shape section of the rear face.

2. The structural unit of claim 1 wherein the S-shape section of the front face is substantially in the center of the front face.

3. The structural unit of claim 1, wherein the S-shape section of the front face comprises a generally concave portion and a generally convex portion.

4. The structural unit of claim 1, wherein the configuration of the S-shape section of the front face has a different configuration than the S-shape section of the first and second side faces.

5. The structural unit of claim 1, wherein the S-shape sections of the first side face and the second side face each comprise a generally convex portion and a generally concave portion.

6. The structural unit of claim 1, wherein at least the front face is irregularly drafted.

7. The structural unit of claim 6, further comprising a natural rock feature in the top surface of the unit.

8. The irregular trapezoidal unit of claim 1, wherein the general S-shape section of the front face is a center rotational image about a first midpoint, and the general S-shaped section of the rear face is a center rotational image about a second midpoint;

wherein the S-shape section of the first side face is a center rotational image about a third midpoint and the S-shape section of the second side face is a center rotational image about a fourth midpoint;

wherein the first and second midpoints are aligned with one another along a first line and the third and fourth midpoints are aligned with one another along a second line;

wherein the first and second lines are perpendicular to one another; and wherein the first line is a centerline of the irregular trapezoidal unit.

9. A partial structure comprising:

a plurality of irregular trapezoidal structural units arranged side to side along a line to form at least a first course, each structural unit comprising:

an upper surface and a lower surface, the lower surface being opposed to the upper surface;

a front face and an opposed rear face disposed between the upper surface and the lower surface, the front face being longer than the rear face;

a first side face and an opposed second side face disposed between the upper surface and the lower surface, wherein both the first side face and the second side face generally extend inwardly in plan view from the front face to the rear face;

wherein the first side face and the second side face include a general S-shape section wherein the general S-shape section of the second side face is a translated image of the general S-shape section of the first side face;

wherein the structural units are arranged such that the S-shape sections of adjacent units mate and interlock;

wherein the front face and the rear face each include a general S-shape section, and wherein the S-shape section of the front face is a translated image of the S-shape section of the rear face.

10. The partial structure of claim 9, wherein the structural units are arranged such that adjacent structural units are reversed in orientation with respect to each other such that adjacent first sides mate and interlock and adjacent second sides mate and interlock.

11. The partial structure of claim 9, further comprising a second course of structural units disposed parallel to and adjacent with the first course;

wherein adjacent structural units in the second course are arranged such that the S-shape sections of adjacent first side faces of the structural units in the second course mate and interlock and the S-shape sections of adjacent second side faces of the structural units in the second course mate and interlock;

wherein the second course is arranged with respect to the first course such that a front face of at least one structural unit in the first course mates and interlocks with either a front face or a rear face of an adjacent structural unit in the second course.

12. The partial structure of claim 9, further comprising a second course of structural units disposed above the first course to form a partial wall structure.

13. The partial structure of claim 9, wherein the front and rear faces on each structural unit are irregularly drafted.

14. The partial structure of claim 9, wherein, in each structural unit, the general S-shape section of the front face is a center rotational image about a first midpoint, and the general S-shaped section of the rear face is a center rotational image about a second midpoint;

wherein, in each structural unit, the S-shape section of the first side face is a center rotational image about a third midpoint and the S-shape section of the second side face is a center rotational image about a fourth midpoint;

wherein, in each structural unit, the first and second midpoints are aligned with one another along a first line and the third and fourth midpoints are aligned with one another along a second line;

wherein, in each structural unit, the first and second lines are perpendicular to one another; and wherein the first line is a centerline of the irregular trapezoidal unit.

15. A partial wall structure comprising:

a plurality of irregular trapezoidal structural wall units arranged side to side along a line to form at least a first course, each structural wall unit comprising:

an upper surface and a lower surface, the lower surface being opposed to the upper surface;

a front face and an opposed rear face disposed between the upper surface and the lower surface, the front face being longer than the rear face;

a first side face and an opposed second side face disposed between the upper surface and the lower surface, wherein both the first side face and the second side face generally extend inwardly in plan view from the front face to the rear face;

wherein the first side face and the second side face include general S-shape sections that are translated images of one another;

wherein the S-shape sections on the sides of adjacent structural wall units mate and interlock with each other; and wherein the front face and the rear face of each unit include general S-shape sections that are translated images of each other.

16. The partial wall structure of claim 15, wherein the front and rear faces on each structural wall unit are irregularly drafted.

17. The partial wall structure of claim 15, further comprising:

a second course of structural wall units disposed above the first course in a bonded arrangement.

18. The partial wall structure of claim 15, further comprising:

a second course of structural wall units disposed laterally adjacent the first course wherein the front and rear faces of the second course mate and interlock with adjacent faces of the first course.

* * * * *